US009498091B2

(12) United States Patent
Yamada

(10) Patent No.: US 9,498,091 B2
(45) Date of Patent: Nov. 22, 2016

(54) WET WIPES PACKAGE

(76) Inventor: Kikuo Yamada, Tokyo (JP)

( * ) Notice: Subject to any disclaimer, the term of this patent is extended or adjusted under 35 U.S.C. 154(b) by 172 days.

(21) Appl. No.: 13/885,854

(22) PCT Filed: Nov. 22, 2011

(86) PCT No.: PCT/JP2011/006502

§ 371 (c)(1),
(2), (4) Date: May 16, 2013

(87) PCT Pub. No.: WO2012/070230

PCT Pub. Date: May 31, 2012

(65) Prior Publication Data

US 2013/0240556 A1 Sep. 19, 2013

(30) Foreign Application Priority Data

Nov. 25, 2010 (JP) ..... 2010-262962
Mar. 14, 2011 (JP) ..... 2011-055729
May 23, 2011 (JP) ..... 2011-114884

(51) Int. Cl.
*B65H 1/00* (2006.01)
*A47K 7/00* (2006.01)
(Continued)

(52) U.S. Cl.
CPC ..... *A47K 7/00* (2013.01); *B65D 75/5894* (2013.01); *B65D 83/0811* (2013.01); *B65D 83/0894* (2013.01)

(58) Field of Classification Search
CPC ..... A47K 7/06; A47K 7/00; B65D 75/5894; B65D 83/0811; B65D 83/0894
USPC ..... 221/63, 45, 282, 48, 47, 33, 303, 44; 206/494, 812, 449, 409
See application file for complete search history.

(56) References Cited

U.S. PATENT DOCUMENTS 1,919,605 A * 7/1933 Swallow ..... A47F 1/085 221/44
3,095,991 A * 7/1963 Paniagua ..... B65D 51/243 215/303

(Continued)

FOREIGN PATENT DOCUMENTS

JP 03-11889 U 3/1991
JP U-04-056638 5/1992

(Continued)

OTHER PUBLICATIONS

English-language translation of Written Opinion of the International Searching Authority issued in International Application No. PCT/JP2011/006502 dated Feb. 21, 2012.

(Continued)

*Primary Examiner* — Rakesh Kumar
(74) *Attorney, Agent, or Firm* — Oliff PLC

(57) ABSTRACT

Provided is a compact wet wipes package, wherein wet wipes can be easily drawn from a storage container, and the production cost can be kept low. This wet wipes package is provided with: a wet wipes folded body which is continuously folded and stacked, and in which dividing portions are formed at a predetermined interval; an airtight storage container which is formed to store the wet wipes folded body and includes an opening portion from which stored wet wipes are to be drawn outward; a base plate which is attached to the opening portion and is formed with a pinching hole through which the wet wipes are pinched and drawn outward; a drawing hole which is linked with the pinching hole and functions to divide the wet wipes at the dividing portion; and openable/closable lid which can hermetically close the pinching hole and the drawing hole.

9 Claims, 32 Drawing Sheets

(51) Int. Cl.
*B65D 75/58* (2006.01)
*B65D 83/08* (2006.01)

(56) References Cited

U.S. PATENT DOCUMENTS 3,749,296 A * 7/1973 Harrison ..... A47K 10/3809 118/43
3,994,417 A * 11/1976 Boedecker ..... A47K 10/32 221/48
4,289,262 A * 9/1981 Finkelstein ..... A47K 10/3809 221/63
4,462,507 A * 7/1984 Margulies ..... A47K 10/3818 206/210
4,526,291 A * 7/1985 Margulies ..... 221/63
4,651,895 A * 3/1987 Niske ..... A47K 10/3818 221/63
4,848,575 A * 7/1989 Nakamura ..... B65D 83/0805 206/449
D307,555 S * 5/1990 Haenni ..... D9/447
5,024,349 A * 6/1991 Haenni ..... A47F 13/085 221/197
5,235,486 A 8/1993 Hibino et al.
5,516,001 A * 5/1996 Muckenfuhs et al. ..... 221/63
5,582,294 A * 12/1996 Yamada ..... B65B 9/067 206/494
5,704,471 A * 1/1998 Yamada ..... B65D 83/0805 206/207
5,729,955 A * 3/1998 Yamada ..... B65B 9/067 206/494
6,053,357 A * 4/2000 Yoh ..... B65D 83/0805 206/494
6,182,858 B1 * 2/2001 Hartog ..... 221/63
6,409,044 B1 * 6/2002 Brown ..... B65D 83/0805 206/812
6,499,626 B1 * 12/2002 Julius ..... A47K 10/421 221/303
6,550,634 B1 * 4/2003 Alegre De Miquel et al. ..... 221/48
6,554,156 B1 * 4/2003 Chong ..... A47K 10/3818 221/303
D479,996 S * 9/2003 Geib ..... D9/434
6,766,919 B2 * 7/2004 Huang ..... B65D 83/0805 206/210
6,951,292 B2 * 10/2005 Bando ..... B65D 83/0805 220/254.3
6,960,349 B2 * 11/2005 Shantz et al. ..... 424/402
7,143,906 B2 * 12/2006 Chasid ..... B65D 83/0805 206/494
D544,346 S * 6/2007 Karussi ..... D9/434
D596,028 S * 7/2009 Bartolucci ..... D9/434
7,922,036 B2 * 4/2011 Bendor ..... A47K 10/42 206/233
8,931,663 B1 * 1/2015 Evans ..... A47K 10/421 206/410
8,944,279 B2 * 2/2015 Shoaf et al. ..... 221/45
2002/0074375 A1 * 6/2002 Irwin ..... A47K 10/32 225/6
2003/0006253 A1 * 1/2003 Yelton et al. ..... 222/494
2003/0015543 A1 * 1/2003 Turbett ..... A47K 10/424 221/63
2003/0080018 A1 * 5/2003 Nally ..... A47K 10/3818 206/494
2005/0035134 A1 * 2/2005 Gamoff et al. ..... 221/37
2005/0205594 A1 * 9/2005 Evans ..... A47K 10/3818 221/63
2005/0279757 A1 * 12/2005 Bitowft et al. ..... 221/45
2006/0180596 A1 * 8/2006 Young ..... A47K 10/421 221/63
2007/0215632 A1 * 9/2007 Bendor ..... A47K 10/42 221/63
2008/0061073 A1 * 3/2008 Laroche ..... 221/46
2009/0014459 A1 1/2009 Hood et al.
2009/0289078 A1 * 11/2009 Melin ..... A47K 10/421 221/45
2013/0240556 A1 * 9/2013 Yamada ..... B65D 75/5894 221/63

FOREIGN PATENT DOCUMENTS

JP U-06-027648 5/1992
JP 08080980 A * 3/1996
JP A-08-080980 3/1996
JP 08143072 A * 6/1996
JP A-08-143072 6/1996
JP 11503392 3/1999
JP A-2004-331158 11/2004
JP 2005519818 A 7/2005
JP A-2007-217054 8/2007

OTHER PUBLICATIONS

International Search Report issued in International Application No. PCT/JP2011/006502 dated Feb. 21, 2012.

* cited by examiner (a)

(b)

(a)

(b)

(a)

(b)

(a)

(b)

(a)

(b)

(a)

(b)

(a)

(b)

(c)

(a)

(b)

(a)

(b)

(a)

(b)

(a)

(b)

(a)

(b)

(a)

(b)

(a)

(b)

(a)

(b)

WET WIPES PACKAGE

TECHNICAL FIELD

The present invention relates to a wet wipes package stored in a storage container of wet wipes.

BACKGROUND ART

Wet wipes used for wiping one's hands or the buttocks of infants, invalids, or aged people have widely been known. Wet wipes are produced by impregnating base cloth with chemicals or the like and are normally stored hermetically in a storage container so that the base cloth can maintain a state wet with chemicals or the like. As the storage container, a bottle-type container in a cylindrical shape has widely been used (see, for example, Patent Literatures 1, 2).

As shown in FIG. 33, a wet wipes storage 201 described in Patent Literature 1 includes rolled wet wipes 202 impregnated with chemicals or the like and a bottle-type storage container 203 to store the wet wipes 202. The rolled wet wipes 202 are produced by rolling wet wipes in a thin belt shape and a dividing portion 204 formed from perforation or the like is provided at regular intervals. The storage container 203 has a container lid 206 removably mounted on an upper part of a container body 205 by screws or the like and can internally store the rolled wet wipes 202. The container lid 206 is provided with a small hole 207 in a substantially circular shape in the center and the wet wipes 202 are drawn out through the small hole 207. The small hole 207 is formed in such a size that, when the tip of the rolled wet wipes 202 is drawn from inside the storage container 203, resistance of magnitude to be able to separate the wet wipes 202 along the dividing portion 204 can be provided. An opening and closing cover 208 to hermetically seal the storage container 203 is freely openably/closably mounted on the container lid 206.

A storage container of wet wipes described in Patent Literature 2 is configured to be able to store rolled wet wipes and has a top cover mounted on an upper part thereof. A drawing port through which to pinch and draw outward the tip of rolled wet wipes, a separation port to separate drawn-out wet wipes, and a linking port to guide wet wipes drawn out from the drawing port to the separation port by linking the drawing bort and the separation port.

CITATION LIST

Patent Literature

Patent Literature 1: Japanese Utility Model Application Laid-Open Publication No. Hei 4-56638U Patent Literature 2: Japanese Patent Application Laid-Open Publication No. 2007-217054

SUMMARY OF INVENTION

Technical Problem

The wet wipes storage 201 described in Patent Literature 1 is configured to be able to provide resistance of magnitude to wet wipes so that the drawn wet wipes are separated along the dividing portion 204. Thus, a problem arises that it is not easy to pass the tip of the wet wipes 202 through the small hole 207 and it is not easy to draw the tip of the wet wipes 202 outward from the small hole 207. In addition, in the case of a wet wipes package described in Patent Literature 1, wet wipes drawn outward are drawn in a wrinkled state after being squeezed by the small hole 207 when passing through the small hole 207. Thus, each time a wet wipe is drawn out, it is necessary for the user to stretch the wet wipe in a squeezed state, causing a problem of very poor workability with increased work before wiping after the wet wipe being drawn out.

The storage container described in Patent Literature 2 has the separation port having a hole size formed so as to be able to provide resistance of such magnitude that wet wipes drawn out of the drawing port are separated along a dividing portion and drawn wet wipes are drawn outward in a wrinkled state. Thus, the user needs to stretch wet wipes in a squeezed state each time wet wipes are drawn out, resulting in very poor workability with increased work before wiping after wet wipes being drawn out. In addition, the storage container described in Patent Literature 2 has the drawing port through which wet wipes are drawn out and the separation port to separate wet wipes formed separately and wet wipes stored in the storage container are in a rolled state and therefore, it is necessary for the user to draw out wet wipes from the drawing port and further move the wet wipes from the drawing port to the separation port to draw the wet wipes outward from the separation port, causing a problem of increased complexity of work with the above work added newly.

A bottle-type wet wipes package generally stores rolled wet wipes in the storage container in a vertical position, causing a problem that it is difficult to make the storage container more compact. In addition, a bottle-type wet wipes package has an increased size of the storage container, causing a problem of higher production costs.

The present invention is made in view of the above problems and an object thereof is to provide a compact wet wipes package in which wet wipes can easily be drawn from a storage container and whose production cost can be kept low.

Solution to Problem

The present invention is:

(1) A wet wipes package including:

a wet wipes folded body of wet wipes which are continuously folded and stacked and in which dividing portions are formed at predetermined intervals;

an airtight storage container formed to be able to store the wet wipes folded body and having an opening formed to draw outward stored wet wipes;

a base plate mounted in the opening and having a pinching hole formed to pinch and draw outward the wet wipes;

a drawing hole linked to the pinching hole to draw out the wet wipes pinched outward from the pinching hole by dividing at each of the dividing portions; and a freely openable/closable lid capable of hermetically sealing the pinching hole and the drawing hole.

(2) The wet wipes package according to the above item (1), wherein the drawing hole is configured to provide frictional resistance to the drawn wet wipes.

(3) The wet wipes package according to the above item (1), wherein the drawing hole is formed in the base plate desposed to an inside of a bag body where a portion of the opening is formed.

(4) The wet wipes package according to the above item (3), wherein the drawing hole is formed at a bottom of a recess of the base plate.

(5) The wet wipes package according to the above item (1), wherein a protruding portion protruding toward an inner side of the drawing hole is formed in the drawing hole.

(6) The wet wipes package according to the above item (5), wherein a protrusion is formed in the drawing hole in a position opposite to the protruding portion.

(7) The wet wipes package according to the above item (1), wherein the drawing hole is formed in a drawing hole forming member made of an elastic material.

(8) The wet wipes package according to the above item (7), wherein the drawing hole is configured to change in hole size in accordance with a thickness of the wet wipes to be passed through the drawing hole.

(9) The wet wipes package according to the above item (7), wherein the base plate has a mounting portion formed to mount a drawing hole forming portion, the drawing hole forming portion has a through hole formed to mount on the mounting portion, and the mounting portion has a boss which can be inserted into the through hole formed thereon.

(10) The wet wipes package according to the above item (7), wherein the drawing hole forming member has a rib protruding outward from an outer circumference of a drawing hole forming portion formed thereon, and a mounting portion has a locking hole capable of locking the rib formed therein.

(11) The wet wipes package according to the above item (7), wherein the drawing hole forming portion is mounted and fixed to a mounting portion by a fixing member as a different body, the fixing member has a fixing hole into which a boss provided on the mounting portion can be inserted formed therein and has a protruding portion protruding outward from an outer circumference thereof, and the mounting portion has a locking hole capable of locking the protruding portion of the fixing member formed therein.

(12) The wet wipes package according to the above item (1), wherein the pinching hole includes an extension extending toward the drawing hole and linked to the drawing hole and the extension is formed to taper down to a point toward the drawing hole.

(13) The wet wipes package according to the above item (1), wherein the wet wipes folded body is formed by folding thereof in a longitudinal direction and then in a lateral direction.

(14) The wet wipes package according to the above item (1), wherein a bag body is formed like a bag in a pillow shape by sealing back and front ends of a film having airtightness.

Advantageous Effects of Invention

A wet wipes package according to the present invention is configured by including a wet wipes folded body which is continuously folded and stacked and in which dividing portions are formed at predetermined intervals, an airtight storage container formed to be able to store the wet wipes folded body and having an opening formed to draw outward stored wet wipes, a base plate mounted in the opening and having a pinching hole formed to pinch and draw outward the wet wipes, a drawing hole linked to the pinching hole to draw out the wet wipes pinched outward from the pinching hole by dividing at the dividing portion, and a freely openable/closable lid capable of hermetically sealing the pinching hole and the drawing hole and therefore, the tip of a wet wipe can easily be pinched and drawn out and also the wet wipe can reliably be divided at the dividing portion. In addition, a wet wipe drawn from the pinching hole moves its position from the pinching hole to the drawing hole when the wet wipe is pulled upward and therefore, the time and effort for the user to move the position where the wet wipe is drawn from the pinching hole to the drawing hole and troublesomeness of work can be reduced.

Also, a wet wipes package according to the present invention stores the wet wipes folded body in the storage container and thus, when a wet wipe is drawn by pinching the tip thereof, the wet wipe is drawn out without distortion being caused. Therefore, the drawn and divided wet wipe is not wrinkled and the time and effort to stretch the wet wipe after being drawn out can be reduced.

Also, a wet wipes package according to the present invention maintains, after a wet wipe being pulled up and divided by the dividing portion, a state in which the tip of the wet wipes folded body (hereinafter, referred to as the tip of the wet wipe) stored in the storage container protrudes from the drawing hole. Therefore, the work of the user to draw out the wet wipe next time can also be done efficiently and troublesomeness of pinching and drawing the tip of a wet wipe each time can be eliminated.

Also, a wet wipes package according to the present invention drawably stores the wet wipes folded body in the storage container and thus, the size of the whole wet wipes package can be made smaller. In addition, by making the wet wipes package smaller on the whole, the production cost of the wet wipes package can significantly be reduced.

DESCRIPTION OF EMBODIMENTS

Figure 1:
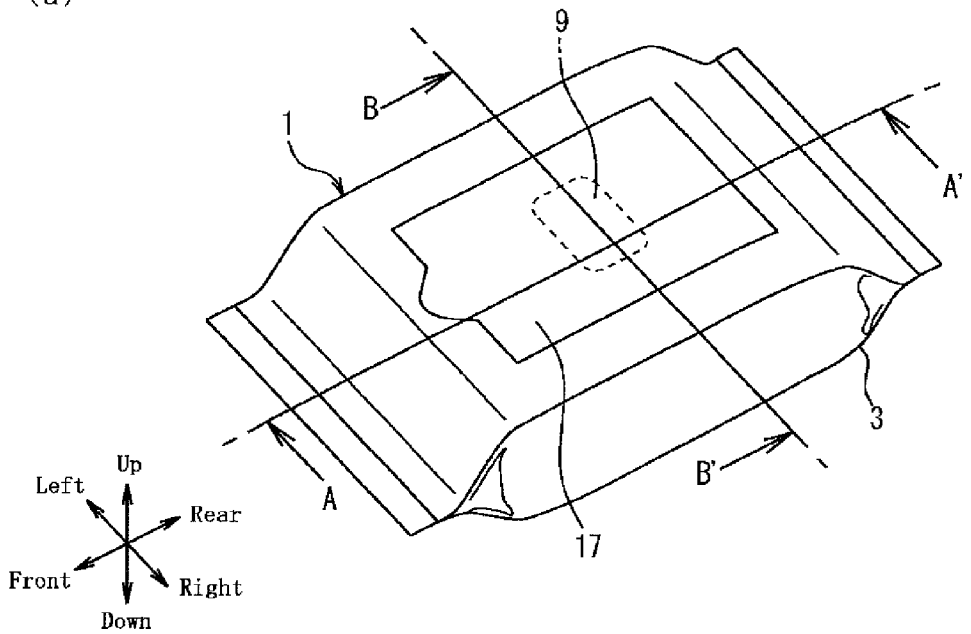
FIG. 1 is an external perspective view showing an external configuration of a wet wipes package according to a first embodiment of the present invention, wherein FIG. 1(*a*) is a diagram showing a state in which a lid is closed and FIG. 1(*b*) is a diagram showing a state in which the lid is open.
Figure 1:
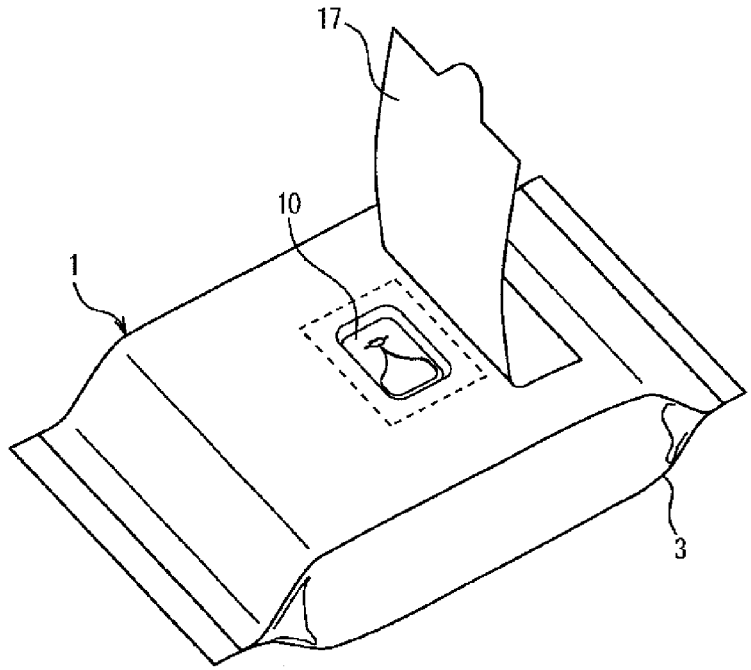
Figure 3:
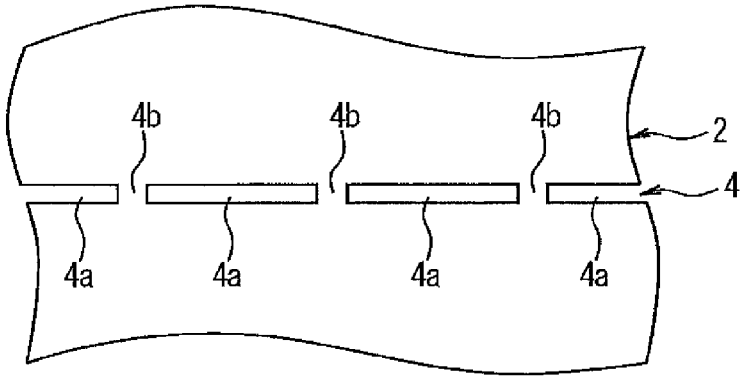
FIG. 3 is a diagram showing the configuration of a wet wipes folded body, wherein FIG. 3(*a*) is a partially enlarged view showing the configuration of a dividing portion of the wet wipes folded body and FIG. 3(*b*) is an explanatory view illustrating the position of the dividing portion of the wet wipes folded body.
Figure 3:
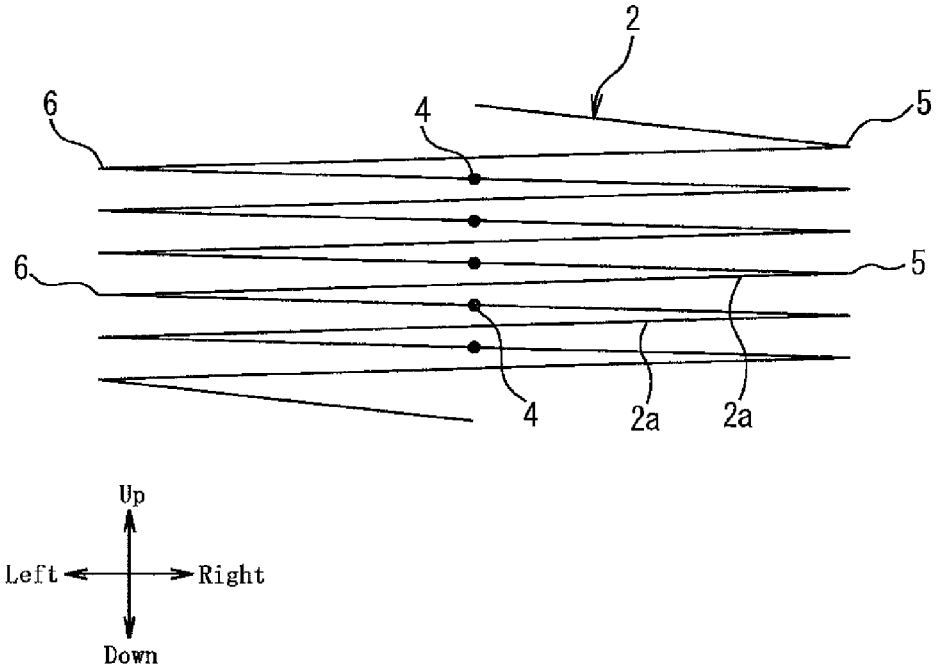
Figure 4:
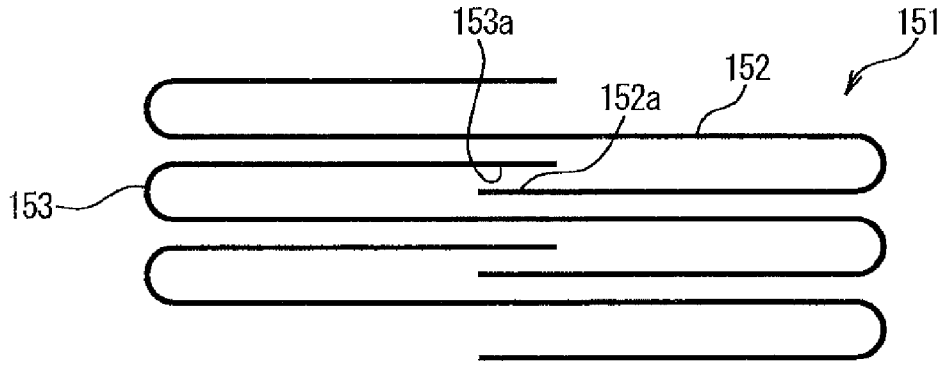
FIG. 4 is a schematic view schematically showing other forms of the wet wipes folded body, wherein FIG. 4(*a*) is a diagram showing a wet wipes folded body folded by a folding method called Z folding and FIG. 4(*b*) is a diagram showing a wet wipes folded body folded by a folding method called WZ folding.
Figure 4:
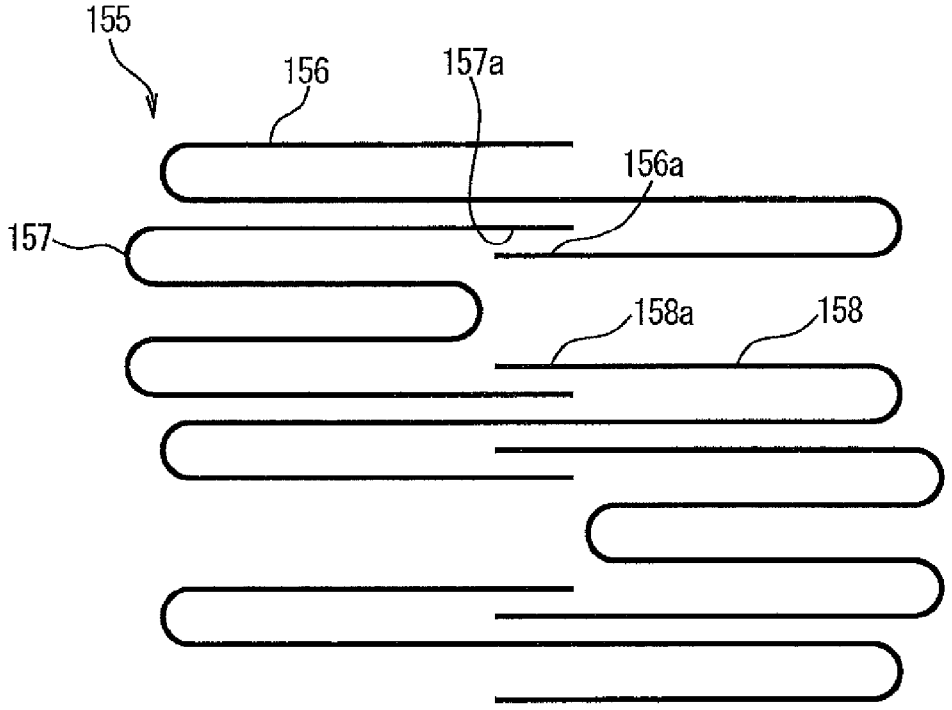
Figure 5:
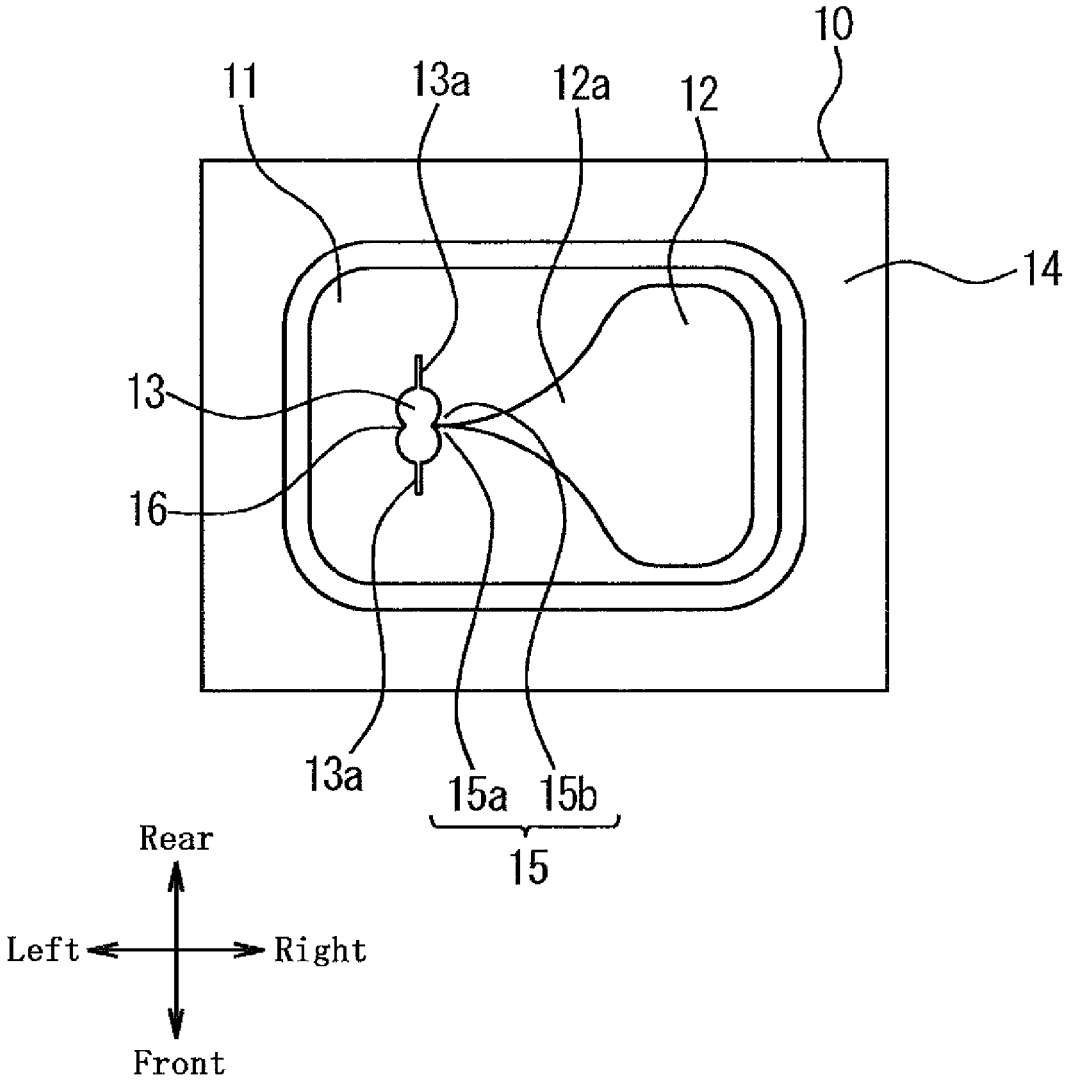
FIG. 5 is a plan view showing the configuration of a base plate.

A first embodiment of a wet wipes package according to the present invention will be described based on FIGS. 1 to 5. FIG. 1 is an external perspective view showing an external configuration of a wet wipes package according to the first embodiment of the present invention, wherein FIG. 1(*a*) is a diagram showing a state in which a lid is closed and FIG. 1(*b*) is a diagram showing a state in which the lid is open, FIG. 2(*a*) is a sectional view taken along an A-A' line of FIG. 1(*a*) and FIG. 2(*b*) is a sectional view taken along a B-B' line of FIG. 1(*a*), FIG. 3 is a diagram showing the configuration of a wet wipes folded body, wherein FIG. 3(*a*) is a partially enlarged view showing the configuration of a dividing portion of the wet wipes folded body and FIG. 3(*b*) is an explanatory view illustrating the position of the dividing portion of the wet wipes folded body, FIG. 4 is a schematic view schematically showing other forms of the wet wipes folded body, wherein FIG. 4(*a*) is a diagram showing a wet wipes folded body folded by a folding method called Z folding and FIG. 4(*b*) is a diagram showing a wet wipes folded body folded by a folding method called WZ folding, and FIG. 5 is a front view showing the configuration of a base plate. Up and down, back and front, and left and right herein refer to up and down, back and front, and left and right shown in FIG. 1. The "tip of wet wipes" herein refers to an edge of the wet wipes folded body stored in a storage container on the side closer to a pinching hole formed in a base plate. Examples in which a bag body as a form of the storage container will be described herein, but a body other than the bag body may also be used as the storage container.

Figure 2:
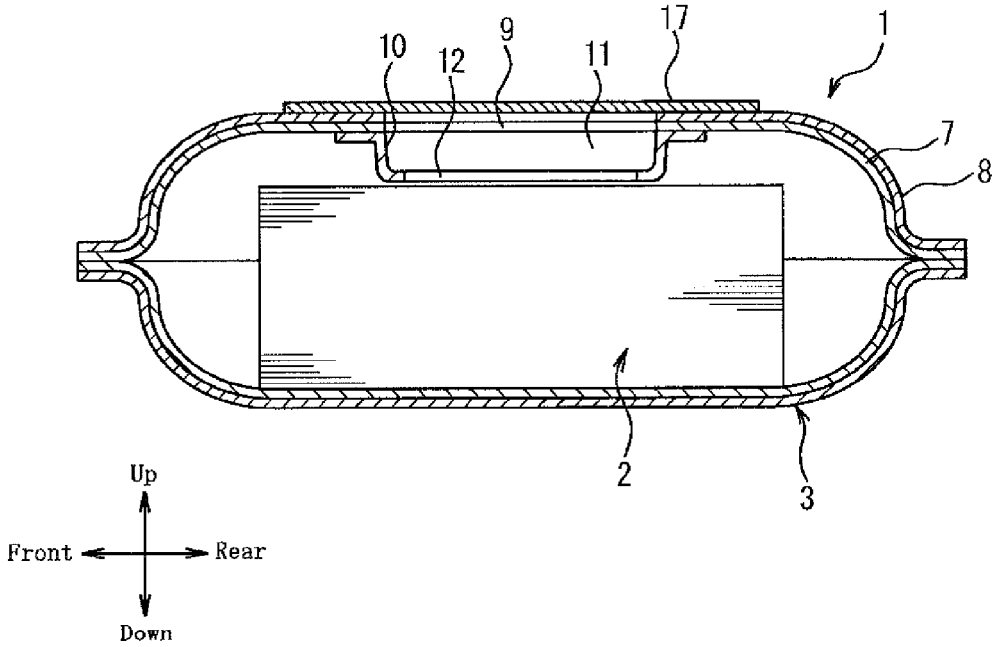
FIG. 2(*a*) is a sectional view taken along an A-A' line of FIG. 1(*a*) and FIG. 2(*b*) is a sectional view taken along a B-B' line of FIG. 1(*a*).
Figure 2:
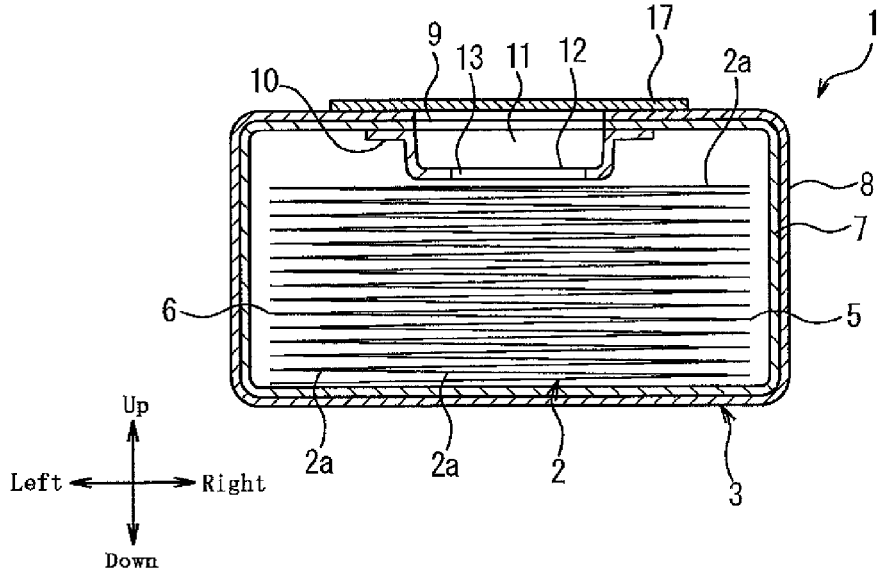

As shown in FIGS. 1 and 2, a wet wipes package 1 according to the first embodiment is configured by a wet wipes folded body 2 being stored inside a bag body 3. The wet wipes folded body 2 is produced by impregnating a base material with chemicals or the like. The wet wipes folded body 2 is configured by alternately providing a plurality of first folded portions 5 and second folded portions 6 to allow the wet wipes folded body 2 to be continuously folded and stacked. The wet wipes folded body 2 is provided with a plurality of dividing portions 4 (see FIG. 3) at predetermined intervals. A wet wipe 2*a* herein mean a sheet wet wipes divided from the wet wipes folded body 2 along the dividing portion 4, but may also mean a wet wipe before being divided from the wet wipes folded body 2.

The dividing portion 4 is formed in such a way that when the wet wipe 2*a* is drawn, the wet wipe 2*a* can be divided by a tensile force provided to the wet wipe 2*a*. As shown in FIG. 3(*a*), the dividing portion 4 has a plurality of slits 4*a* provided at fixed intervals in the width direction of the wet wipes folded body 2 and connecting portions 4*b* connecting the wet wipes folded body 2 are formed between these slits 4*a*. In the first embodiment, the connecting portion 4*b* is formed at three locations in the width direction of the wet wipes folded body 2, but the number of the connecting portions 4*b* and the shape thereof are not limited to the above example. The dividing portion 4 only needs to be configured so that the connecting portion 4*b* is divided when a tensile force acts thereon and, for example, perforation may be formed by shortening the interval between the slit 4*a* and the connection portion 4*b* or other shapes may be formed.

Examples of the configuration of the wet wipes folded body having a dividing portion in other forms will be described based on FIG. 4. FIG. 4 is a schematic view showing the configuration of wet wipes folded bodies having dividing portions of other forms, wherein FIG. 4(*a*) shows the configuration of a wet wipes folded body folded by a folding method called Z folding and FIG. 4(*b*) shows the configuration of a wet wipes folded body folded by a folding method called WZ folding. The folding configuration of a wet wipes folded body only needs to be configured so that when a wet wipe is pulled up, the next wet wipe pops up by being successively pulled up continuously and the folding configuration may be not only the above Z folding or WZ folding, but also W folding or other folding.

As shown in FIG. 4(*a*), a wet wipes folded body 151 having the folding configuration of Z folding is configured by stacking a plurality of wet wipes folded in a Z shape. The wet wipes folded body 151 is configured to have an upper surface of an end edge 152*a* of a wet wipe 152 and an undersurface of a start edge 153*a* of a next wet wipe 153 stacked overlapping with each other and when the wet wipe 152 is drawn out, the end edge 152*a* of the wet wipe 152 acts to pull up the start edge 153*a* of the next wet wipe 153 and when the start edge 153*a* of the next wet wipe 153 is drawn out of a bag body through a drawing port (not shown), the end edge 152*a* of the wet wipe 152 and the start edge 153*a* of the next wet wipe 153 are separated.

As shown in FIG. 4(*b*), a wet wipes folded body 155 in the WZ folding is configured by alternately stacking a wet wipe 156 folded in a Z shape and a wet wipe 157 folded in a W shape. The wet wipes folded body 155 is configured to have the upper surface of an end edge 156*a* of a wet wipe 156 in the Z folding and the undersurface of a start edge 157*a* of a wet wipe 157 in the W folding positioned next stacked overlapping with each other and when the wet wipe 156 in the Z folding is drawn out, the end edge 156*a* of the wet wipe 156 acts to pull up the start edge 157*a* of the next wet wipe 157 in the W folding and when the start edge 157*a* of the next wet wipe 157 in the W folding is drawn out of a bag body through a drawing port (not shown), the end edge 156*a* of the wet wipe 156 in the Z folding and the start edge 157*a* of the next wet wipe 157 in the W folding are separated. When, after the wet wipe 157 in the W folding is drawn out, a start edge 158*a* of a wet wipe 158 in the Z folding is drawn, the start edge 158*a* of the wet wipe 158 is pulled up by the same action.

FIG. 3(*b*) is an explanatory view showing in which positions of the wet wipes folded body 2 the dividing portion 4 of the wet wipes folded body 2 is positioned. In FIG. 3(*b*), the position of the dividing portion 4 is indicated by a black circle. As shown in FIG. 3(*b*), the wet wipes folded body 2 is configured so that the dividing portion 4 is positioned in the center between the first folded portion 5 and the second folded portion 6 and a portion with the dividing portion 4 and a portion without the dividing portion 4 are alternately positioned vertically.

However, the configuration of the wet wipes folded body 2 is not limited to the above example and any configuration that can be stored in the bag body 3 may be adopted. For example, the dividing portion 4 is positioned in the center between the first folded portion 5 and the second folded portion 6 in the present embodiment, but the dividing portion 4 may also be arranged in other positions. In addition, the dividing portion 4 may be arranged in the position where the first folded portion 5 or the second folded portion 6 is formed. Further, the wet wipes folded body 2 is configured in such a way that a portion with the dividing portion 4 and a portion without the dividing portion 4 are alternately positioned vertically in the present embodiment, but wet wipes may also be folded so that portions with the dividing portion 4 overlap vertically. In addition, the dividing portion 4 may be arranged in both positions where the first folded portion 5 and the second folded portion 6 are formed.

In the first embodiment, the wet wipes folded body 2 is configured by folding in the lateral direction, but may be configured by folding in the longitudinal direction and then in the lateral direction. By folding in the longitudinal direction before folding in the lateral direction, the wet wipes folded body 2 can be stored in the more compact bag body 3 so that portability can be improved.

Various base materials that have been publicly known may be used as the base material for the wet wipes folded body 2. Also, various chemicals that have been publicly known may be used as chemicals with which the base material of the wet wipes folded body 2 is impregnated.

The bag body 3 storing the wet wipes folded body 2 is formed as a bag like form such as a pillow shape as shown in FIG. 1 by hermetically heat sealing or the like back and front ends of a plastic film or the like having airtightness and flexibility.

As shown in FIG. 2, the bag body 3 is formed of, for example, two layers of an inner layer 7 and an outer layer 8. A film made of plastics such as polyethylene, polypropylene, polyester, polyamide, vinyl chloride, vinylidene chloride, and cellophane, a laminated film made of these two films or more, or a complex film produced by stacking aluminum foil on a single film or a laminated film is used as the inner layer 7 and a polyethylene terephthalate (PET) film is used as the outer layer 8. The bag body 3 is formed of two layers of the inner layer 7 and the outer layer 8 in the present embodiment, but the present embodiment is not limited to two layers and the bag body 3 may be formed of three layers or more or one layer. Materials used for the inner layer 7 and the outer layer 8 are not to be limited to the materials described above.

As shown in FIGS. 1 and 2, the bag body 3 has an opening 9 formed therein and a base plate 10 is mounted in the opening 9. The base plate 10 is mounted on the inner side of the bag body 3 by a method like hot melt or heat seal. The base plate 10 is a plate-like member molded from a thermoplastic resin material such as polyethylene and polypropylene. As shown in FIGS. 2 and 5, the base plate 10 has a recess 11 in the center and a pinching hole 12 and a drawing hole 13 are formed at the bottom of the recess 11. Incidentally, reference numeral 14 in FIG. 5 is a welding face to mount the base plate 10 on the inner surface of the bag body 3 by hot melt, heat seal or the like.

The pinching hole 12 is a hole to pinch and draw outward the wet wipe 2*a*. As shown in FIG. 5, the pinching hole 12 is formed on the right side of the recess 11 and formed in a size allowing pinching the wet wipe 2*a* stored inside the bag body 3. The pinching hole 12 includes an extension 12*a*. The extension 12*a* extends toward the drawing hole 13 and is formed so as to be linked to the drawing hole 13 and the extension 12*a* is formed to taper down to a point toward the drawing hole 13.

The drawing hole 13 is used to divide the wet wipes folded body 2 along the dividing portion 4. The drawing hole 13 is linked to the extension 12*a* of the pinching hole 12 and configured to be able to provide frictional resistance to the drawn wet wipe 2*a*. The drawing hole 13 is formed in a shape formed by partially overlaying two circles and a protruding portion 15 is formed in a portion protruding toward the inner side of the drawing hole 13 by the two circles being overlaid. The extension 12*a* is formed in the protruding portion 15 like dividing the protruding portion 15 in a back and front direction and in the present embodiment, the protruding portion 15 includes two protrusions 15*a*, 15*b*. The protruding portion 15 is used to prevent the wet wipes folded body 2 drawn from inside the drawing hole 13 from moving to the pinching hole 12 and to increase frictional resistance provided to the drawn wet wipes folded body 2.

A protrusion 16 protruding toward the inner side of the drawing hole 13 is formed in a position opposite to the protruding portion 15 in the drawing hole 13. The protrusion 16 is formed to increase frictional resistance provided to the drawn wet wipes folded body 2. Incidentally, reference numeral 13*a* in FIG. 5 is a slit formed by extending from the drawing hole 13 in the back and front direction.

The protruding portion 15 only needs to be able to increase frictional resistance provided to the wet wipes folded body 2 and prevent the wet wipes folded body 2 drawn from inside the drawing hole 13 from moving to the pinching hole 12 and the shape and size thereof are not limited. The protrusion 16 only needs to be able to increase frictional resistance provided to the wet wipes folded body 2 and the shape and size thereof are not limited.

As shown in FIGS. 1 and 2, a lid 17 is provided on the upper surface of the bag body 3. The lid 17 is freely openably/closably provided on the upper surface of the bag body 3 by the method of hot melt or the like so that the pinching hole 12 and the drawing hole 13 provided in the base plate 10 can be hermetically sealed. The lid 17 is formed from a film or sheet material having flexibility and pliability. An adhesive layer (not shown) is formed on the undersurface of the lid 17 and when the lid 17 is stuck to the upper surface of the bag body 3, the inside of the bag body 3 is hermetically sealed. An acrylic adhesive paste, polyvinyl chloride composition containing plasticity, or a pressure sensitive adhesive containing a graftmer like a graft copolymer in which a vinyl chloride monomer is graft-polymerized with an ethylene-vinyl acetate copolymer as a main body is used as the adhesive layer, but the adhesive layer is not limited to the above example. The shape of the lid 17 is not limited to a rectangular shape with a grip attached to the front as shown in FIG. 1 and the shape thereof is not limited as long as the pinching hole 12 and the drawing hole 13 can hermetically be sealed.

Figure 6:
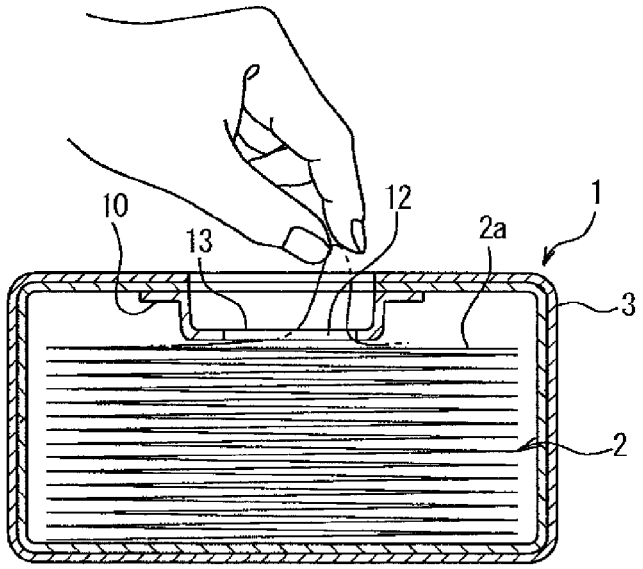
FIG. 6 is an explanatory view illustrating an operation when wet wipes are drawn out from inside a bag body, wherein FIG. 6(*a*) is a diagram in which the tip of wet wipes is pinched to draw from inside the bag body and FIG. 6(*b*) is a diagram in which the pinched wet wipes are drawn upward.
Figure 6:
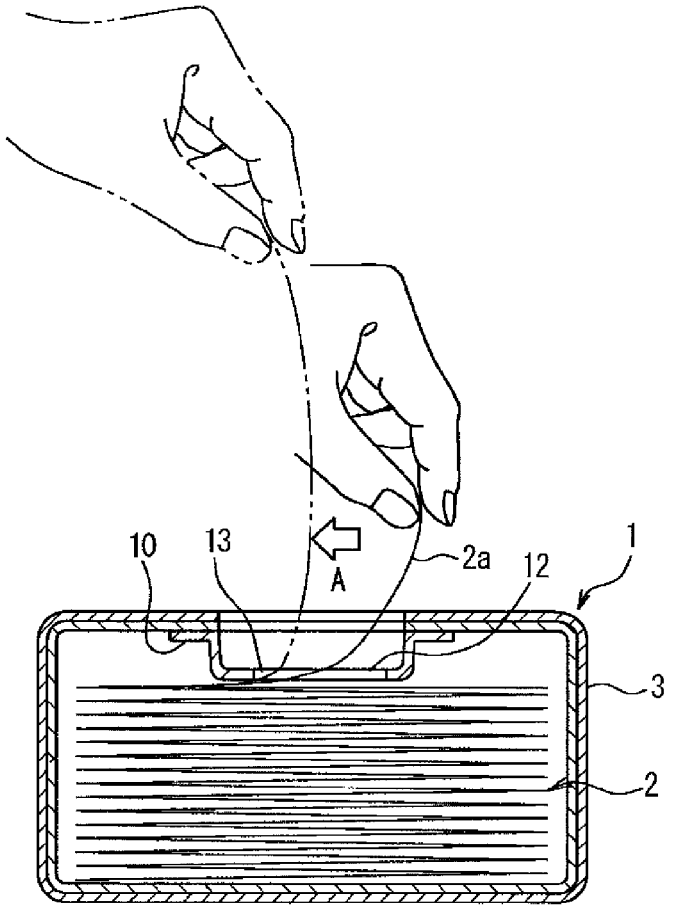

Next, the operation when the wet wipes folded body 2 is drawn from the bag body 3 in the wet wipes package 1 according to the present embodiment will be described based on FIG. 6. FIG. 6 is a diagram showing the operation when the wet wipes folded body 2 is drawn from the bag body 3, wherein FIG. 6(*a*) is a diagram showing a state in which a user pinches the wet wipes folded body 2 and FIG. 6(*b*) is a diagram showing a state in which the user is drawing upward the pinched wet wipes folded body 2

When, as shown in FIG. 6(*a*), the tip of the wet wipes folded body 2 does not protrude from the bag body 3, the user inserts his (her) fingers into the bag body 3 through the pinching hole 12, pinches the tip of the wet wipe 2*a* stored in the bag body 3, and pulls up the tip of the wet wipe 2*a* out of the bag body 3 from the pinching hole 12 to draw out the wet wipe 2*a*. In this case, the pinching hole 12 is opened and formed in a size allowing pinching the tip of the wet wipe 2*a* and thus, the user can easily insert his (her) fingers into the bag body 3 and pinch the wet wipe 2*a* and the user can also do the work of pulling up and drawing out the tip of the wet wipe 2*a* easily.

An upward force is acted on the wet wipe 2*a* by the wet wipe 2*a* being pulled up by the user. At this point, the wet wipes folded body 2 is stored inside the bag body 3 and if an upward force is applied by the user, a portion of the force acts in a direction that moves the pulled-up wet wipe 2*a* in a left and right direction. Thus, when, as shown in FIG. 6(*b*), pulled upward and drawn from the pinching hole 12, the wet wipe 2*a* is pulled upward while moving in an A direction in FIG. 6(*b*) before being drawn out of the bag body 3.

While moving from the pinching hole 12 to the drawing hole 13, the wet wipe 2*a* moves to the drawing hole 13 by being guided by the extension 12*a* of the pinching hole 12. After moving to the drawing hole 13, the wet wipe 2*a* is prevented from moving from the drawing hole 13 to the pinching hole 12 by the protruding portion 15 and then drawn out from the drawing hole 13. In this case, the drawing hole 13 is formed smaller than the pinching hole 12 and further the protruding portion 15 and the protrusion 16 are formed so that the gap therebetween is small and therefore, the wet wipe 2*a* is pulled up while being subject to strong resistance. The resistance at this point is increased by the protruding portion 15 and the protrusion 16.

When the wet wipe 2*a* is pulled up by a predetermined length, the dividing portion 4 is passed through the drawing hole 13. At this point, the force acting on the dividing portion 4 becomes larger than other forces acting on other places than the dividing portion 4. Thus, the wet wipe 2*a* is divided at the dividing portion 4 immediately after the dividing portion 4 passes through the drawing hole 13 so that a sheet of the wet wipe 2*a* is drawn out.

At this point, the tip portion of the wet wipe 2*a* positioned below the divided wet wipe 2*a* protrudes from the drawing hole 13 by a predetermined length and the drawing hole 13, the protruding portion 15, and the protrusion 16 maintain a state in which the wet wipe 2*a* protrudes from the drawing hole 13 by a predetermined length. Thus, when the user draws the wet wipe 2*a* out of the bag body 3 next time, the tip of the wet wipes folded body 2 protruding from the drawing hole 13 may simply be pulled upward so that the sheet wet wipe 2*a* can be obtained more simply.

If, after the sheet wet wipe 2*a* is drawn out, the wet wipe 2*a* is not drawn out subsequently, the lid 17 is stuck to the upper surface of the bag body 3 to close wet wipes package 1. At this point, the lid 17 is stuck to the upper surface of the bag body 3 by the adhesive layer so that airtightness inside the bag body 3 can be maintained and the bag body 3 can be hermetically sealed to prevent chemicals or the like with which the wet wipes folded body 2 is impregnated from volatilizing. In addition, a protruding portion of the wet wipe 2*a* from the drawing hole 13 can be stored inside the recess 11 formed in the base plate 11. Thus, when the lid 17 is stuck to the upper surface of the bag body 3, a gap between the bag body 3 and the lid 17 is less likely to be generated and so chemicals or the like can reliably be prevented from volatilizing from wet wipes.

The wet wipes package 1 in the present embodiment is provided with the protruding portion 15 and the protrusion 16 in the drawing hole 13 and the interval between the protruding portion 15 and the protrusion 16 is made short and thus, sufficient resistance can be provided to the wet wipe 2*a* without making the hole size of the drawing hole 13 smaller than necessary. Therefore, when the wet wipe 2*a* is drawn out, the wet wipe 2*a* can be drawn out while a state in which the user can use the wet wipe 2*a* readily is maintained without the wet wipe 2*a* being squeezed and wrinkled. Therefore, according to the wet wipes package 1 in the present embodiment, time and effort can be saved when the user uses wet wipes and troublesomeness in use can significantly be reduced.

Also in the wet wipes package 1 in the present embodiment, the wet wipes 2*a* are configured as the wet wipes folded body 2 folded by having a plurality of folded portions and therefore, the size of the whole wet wipes package 1 can be made compact and the cost during production can be reduced significantly.

Next, a second embodiment of a wet wipes package according to the present invention will be described based on FIGS. 7 to 14. The description of the same configuration portions of a wet wipes package 21 according to the second embodiment as those described above is omitted and also the same reference numerals are used. An example using a wet wipes folded body whose dividing portion is formed by overlaying and stacking edges of wet wipes in Z folding, WZ folding, or W folding will be described, but a wet wipes folded body of a different configuration may also be used.

Figure 7:
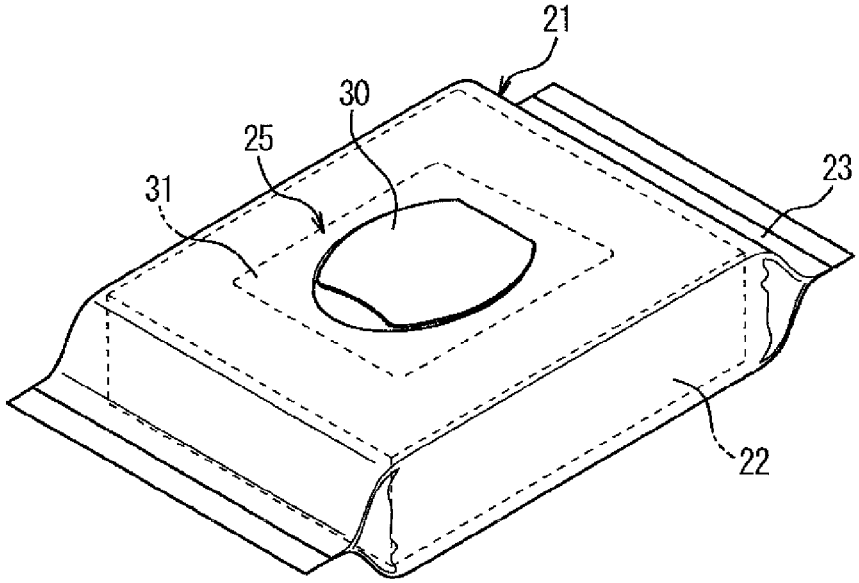
FIG. 7 is an external perspective view showing the external configuration of a wet wipes package according to a second embodiment of the present invention, wherein FIG. 7(*a*) is a diagram showing a state in which a lid is closed and FIG. 7(*b*) is a diagram showing a state in which the lid is open.
Figure 7:
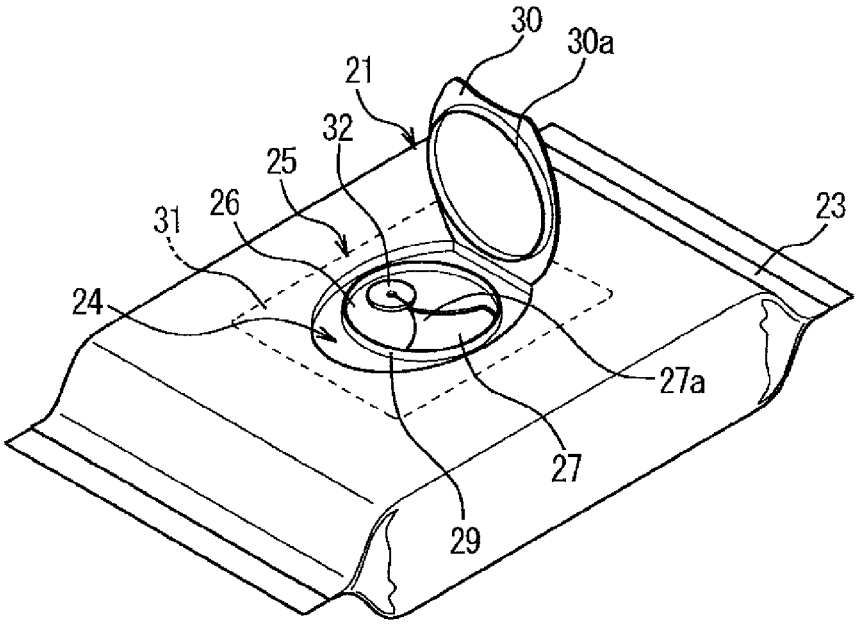

The wet wipes package 21 according to the second embodiment is configured by a wet wipes folded body 22 being stored inside a bag body 23 as a storage container. As shown in FIGS. 7(*a*) and 7(*b*), the bag body 23 has an opening 24 formed therein and a base plate 25 is mounted in the opening 24 by an arbitrary method such as hot melt. The base plate 25 is a member molded by using an arbitrary method that has been publicly known from a thermoplastic resin material such as polyethylene and polypropylene and has a recess 26 formed in the center, and a pinching hole 27, a mounting hole 28 in which a drawing hole forming member 32 is mounted, and an upper wall portion 29 are formed in the recess 26. In addition, a lid 30 is freely openably/closably formed in the base plate 25. Incidentally a portion formed in a plane shape on an outer circumferential side from the recess 26 and denoted by reference numeral 31 is a welding surface to mount the base plate 25 on the bag body 23 by an arbitrary method such as hot-melt or the like.

The pinching hole 27 to pinch and draw outward a wet wipe 22*a* is formed in a size allowing pinching the wet wipe 22*a* of the wet wipes folded body 22 stored inside the bag body 23. The pinching hole 27 includes an extension 27*a*. The extension 27*a* extends toward the mounting hole 28 and is formed so as to be linked to the mounting hole 28. The extension 27*a* is formed to taper down to a point toward the mounting hole 28.

Figure 8:
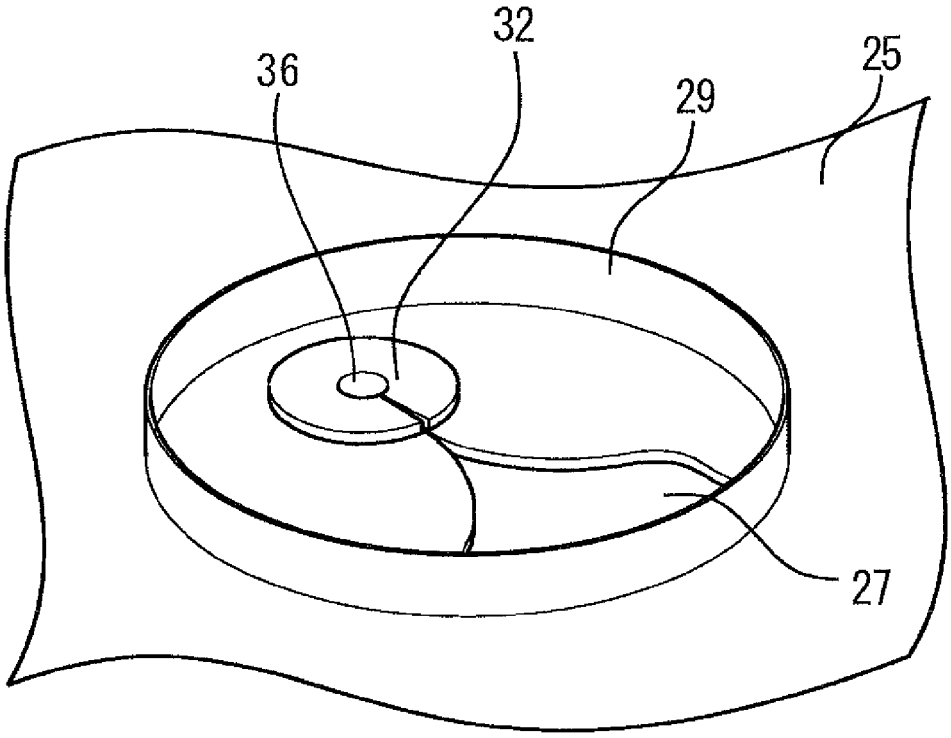
FIG. 8 is an enlarged perspective view showing the configuration of a portion where a pinching hole is formed and a drawing hole forming member is provided.

The mounting hole 28 is formed in the base plate 25. As shown in FIG. 8, the mounting hole 28 is formed so as to be linked to the pinching hole 27 and also in such a size that the drawing hole forming member 32 is locked.

When the wet wipes package 21 is viewed from above, the upper wall portion 29 is formed in a circular shape inside the recess 26. The upper wall portion 29 is configured so that when the lid 30 is closed, the upper wall portion 29 fits to a lid wall portion 30*a* formed on the lid 30 to maintain airtightness to be able to secure airtightness inside the bag body 23. The upper wall portion 29 is formed so as to have an outside diameter substantially equal to the inside diameter of the lid wall portion 30*a* or slightly smaller and is configured so that the outer circumferential surface of the upper wall portion 29 and the inner circumferential surface of the lid wall portion 30*a* are in contact when the lid 30 is closed. The upper wall portion 29 is provided upright so that the height thereof is lower than the depth of the recess 26. Incidentally, the upper wall portion 29 may be formed so as to have an inside diameter substantially equal to the outside diameter of the lid wall portion 30*a* or slightly larger and may be configured so that the inner circumferential surface of the upper wall portion 29 and the outer circumferential surface of the lid wall portion 30*a* are in contact when the lid 30 is closed.

The drawing hole forming member 32 is formed from an elastic member softer than the base plate 25 and any material that has been publicly known may be applied as the elastic material, but in terms of ease of elastic deformation, a rubber material such as natural rubber and synthetic rubber, PP (polypropylene), PE (polyethylene), vinyl resin or the like is preferable. When synthetic rubber is used, it is preferable to use silicon rubber, urethane rubber or the like.

Figure 9:
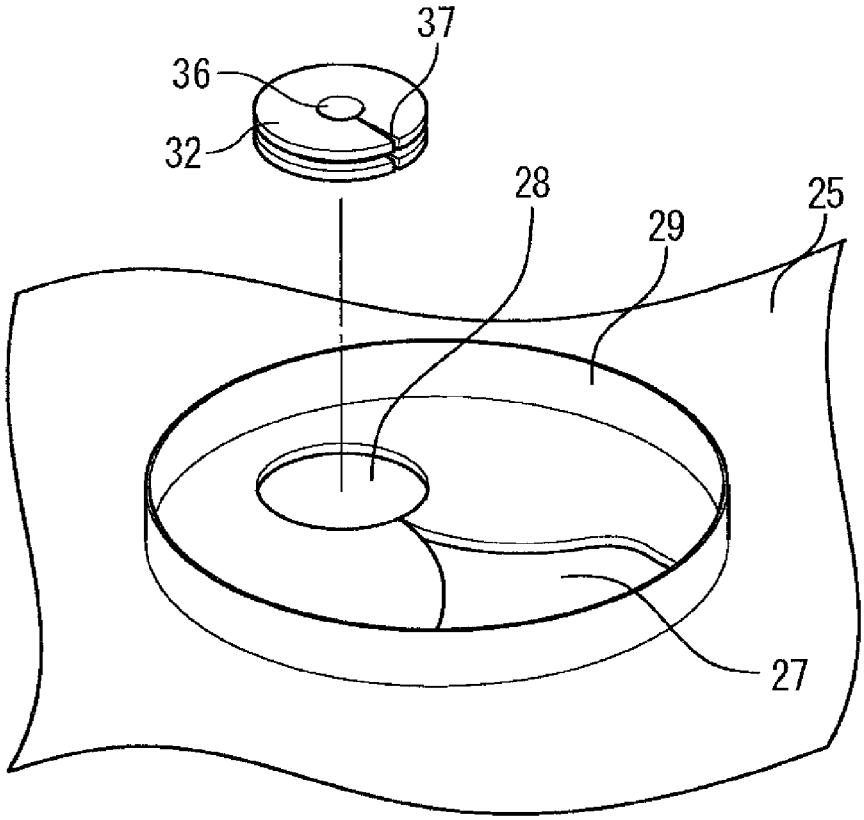
FIG. 9 is an exploded perspective view showing the configuration of the portion where the pinching hole is formed and the drawing hole forming member is provided.
Figure 10:
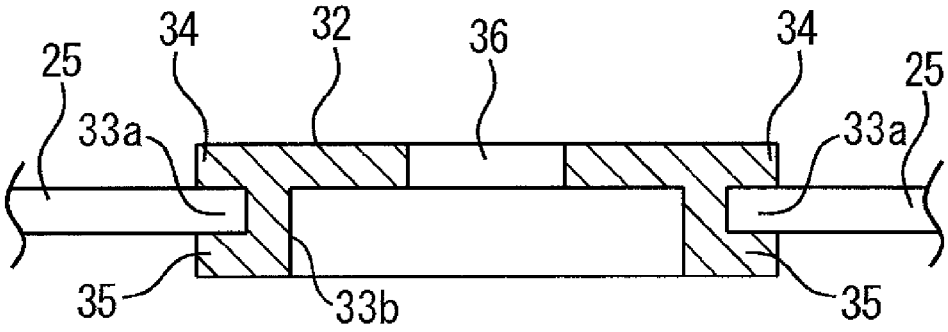
FIG. 10 is a sectional view showing the configuration of the drawing hole forming member.
Figure 11:
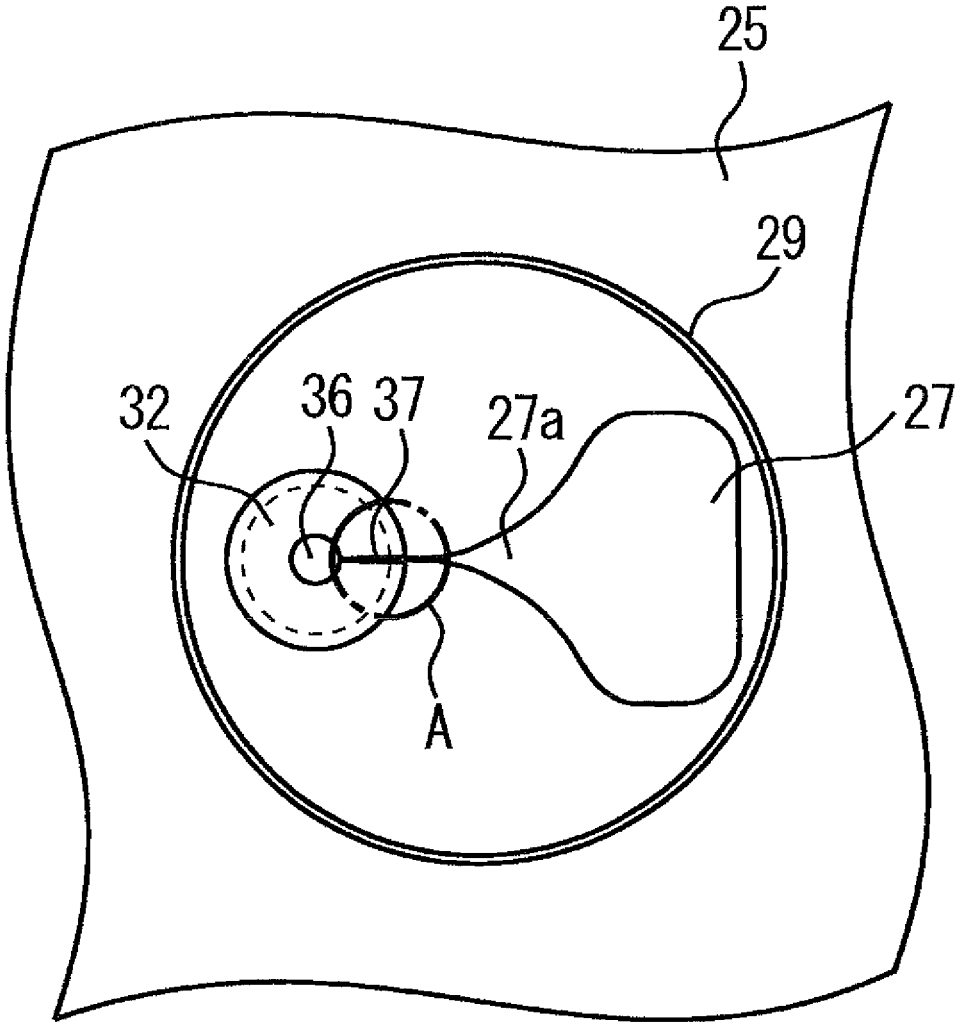
FIG. 11 is a plan view showing the portion where the pinching hole is formed and the drawing hole forming member is provided.

As shown in FIGS. 9 to 11, the drawing hole forming member 32 has a first recess 33*a* formed in the center of the side face and also a first protruding portion 34 and a second protruding portion 35 protruding toward the first recess 33*a* at both upper and lower ends of the first recess 33*a*. In addition, a drawing hole 36 formed in a substantially circular shape in a plane view of the drawing hole forming member 32 is formed in the center of the drawing hole forming member 32 and also a slit 37 is formed from the drawing hole 36 to the outer circumferential surface. Also, the drawing hole forming member 32 has a second recess 33*b* formed from the lower part toward the upper part. The drawing hole forming member 32 is locked into the mounting hole 28 of the base plate 25. In the locked drawing hole forming member 32, an end of the base plate 25 is inserted into the first recess 33 formed between the first protruding portion 34 and the second protruding portion 35, the undersurface of the first protruding portion 34 is opposed to the upper surface of the base plate 25, and the upper surface of the second protruding portion 35 is opposed to the undersurface of the base plate 25 to arrange the drawing hole forming member 32 so as not to move up and down relative to the base plate 25 and further the outer circumferential surface of the first recess 33 and the inner circumferential surface of the mounting hole 28 are opposed to arrange the drawing hole forming member 32 so as not to move back and front, left and right relative to the base plate 25.

Figure 12:
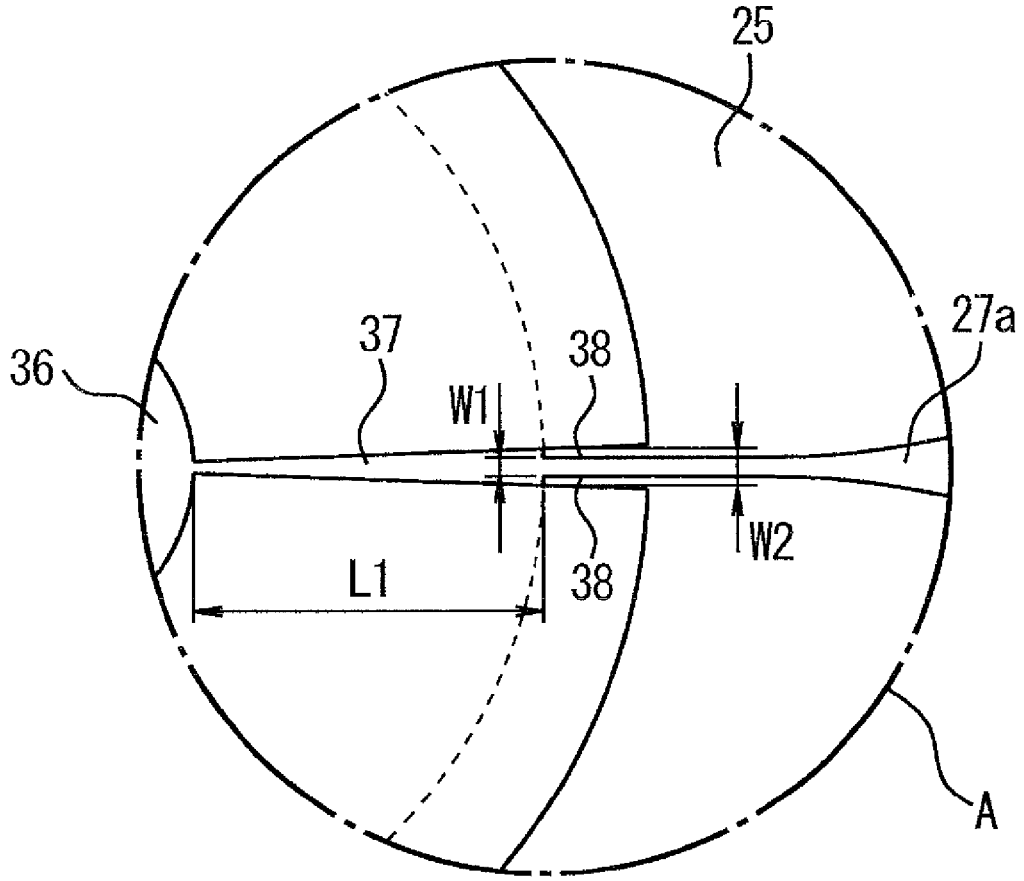
FIG. 12 is an enlarged view showing an A portion of FIG. 10.

As shown in FIG. 12, the drawing hole forming member 32 is arranged in such a way that the extension 27*a* of the pinching hole 27 and the slit 37 of the drawing hole forming member 32 are positioned in the same position and is configured so that the pinching hole 27 and drawing hole 36 are linked via the extension 27*a* and the slit 37. In this case, it is preferable to form a protruding portion 38 in such a way that a width W1 of the end of the extension 27*a* linked to the mounting hole 28 becomes smaller than a width W2 of the slit 37. By forming the protruding portion 38 in this manner, the wet wipe 22*a* drawn from the drawing hole 36 can be prevented from moving toward the pinching hole 27 and the wet wipe 22*a* can reliably divided at the dividing portion 4.

In the drawing hole forming member 32, a distance L1 from the boundary portion between drawing hole 36 and the slit 37 to the tip of the protruding portion is preferably 10 mm or less and particularly preferably 6 mm or less. By positioning the protruding portion 38 in such a position, when the wet wipe 22*a* passes through the drawing hole 36, a force provided from the wet wipe 22*a* to the protruding portion 38 does not become too excessive and the protruding portion 38 can be prevented from becoming a taxiway permitting movement from the drawing hole 36 to the pinching hole 27 by being lifted when the wet wipe 22*a* passes so that the wet wipe 22*a* can reliably be prevented from moving from the drawing hole 36 to the pinching hole 27.

Figure 13:
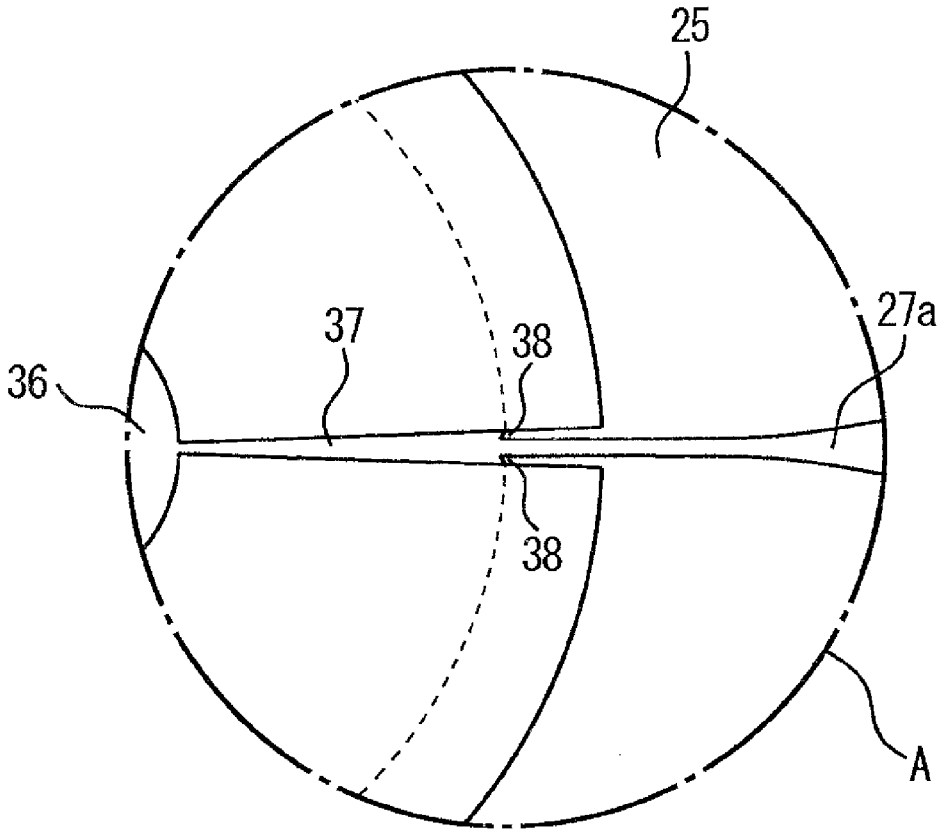
FIG. 13 is an enlarged view showing the A portion of FIG. 10 and is a diagram showing the configuration of a protruding portion of a modification of the present embodiment.

In the second embodiment, the end of the protruding portion 38 is formed in a direction at right angles to a line connecting the center of the pinching hole 27 and the center of the drawing hole 36, but as shown, for example, in FIG. 13, the protruding portion 38 may be formed by protruding toward the inner side of the drawing hole 36. In this case, stronger resistance can be provided to the wet wipe 22*a* passing through the drawing hole 36 and the wet wipe 22*a* can be divided by the dividing portion 4 more reliably.

Next, the operation when the wet wipe 22*a* is drawn from the drawing hole 36 in the wet wipes package 21 according to the second embodiment will be described based on FIG. 14. Like the wet wipes package 1 according to the first embodiment, if the tip of the wet wipe 22*a* does not protrude from the bag body 23, the user inserts his (her) fingers into the bag body 23 through the pinching hole 27 and pinches and pulls up the tip of the wet wipe 22*a* stored in the bag body 23 to draw outward the tip of the wet wipe 22*a* out of the bag body 3 from the pinching hole 27. In this case, the pinching hole 27 is opened and formed in a size allowing pinching the tip of the wet wipe 22*a* and thus, the user can easily insert his (her) fingers into the bag body 23 and pinch the wet wipe 22*a* and the user can easily draw out the tip of the wet wipe 22*a*.

Also in the wet wipes package 21 according to the second embodiment, like the wet wipe 2*a* according to the first embodiment, the wet wipes folded body 22 is stored inside the bag body 23 and thus, if an upward force acts on the wet wipe 22*a* when the user pulls up the tip of the wet wipe 22*a*, a portion of the force acts as a force in a direction that moves the pulled-up wet wipe 22*a* in a left and right direction. Thus, when pulled upward and drawn from the pinching hole 27, the wet wipe 22*a* moves from the pinching hole 27 toward the drawing hole 36 at the same time.

Figure 14:
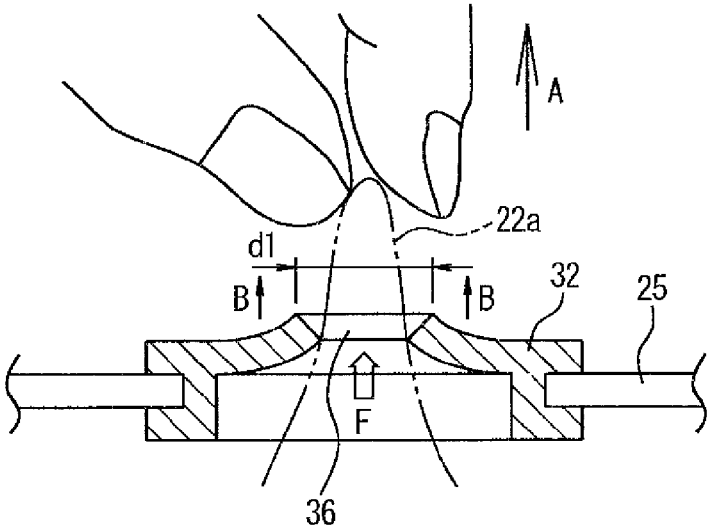
FIG. 14 is an explanatory view illustrating the operation when wet wipes are drawn out from the drawing hole, wherein FIG. 14(*a*) is a diagram when wet wipes are drawn out, FIG. 14(*b*) is a diagram when dividing portion of the wet wipes passes through the drawing hole, and FIG. 14(*c*) is a diagram showing a state after the wet wipes have been drawn out.
Figure 14:
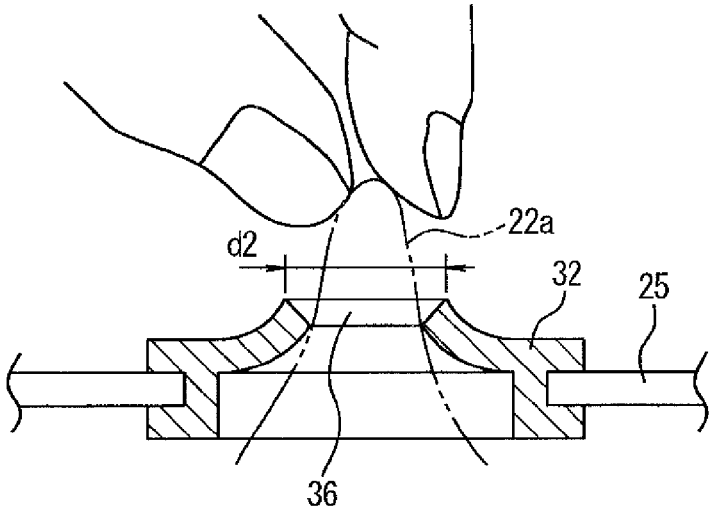
Figure 14:
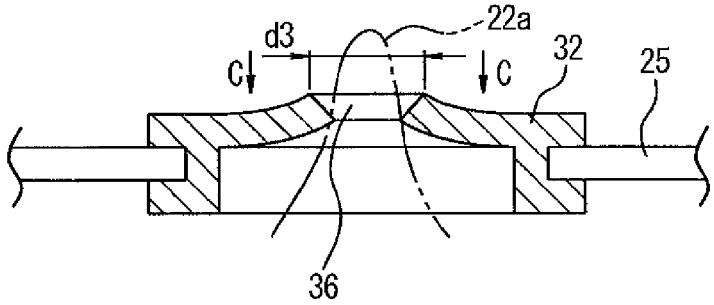

When, as shown in FIG. 14(*a*), the user draws out the wet wipe 22*a* from the drawing hole 36, an upward force F is provided to the drawing hole forming member 32 by the wet wipe 22*a* being pulled and drawn upward (A direction in FIG. 14(*a*)) from the drawing hole 36 and a portion where the drawing hole 36 is formed in the drawing hole forming member 32 is elastically deformed in a B direction in FIG. 14(*a*). For example, while the wet wipe 22*a* is drawn out, the dividing portion 4 where the tips of the wet wipes 22*a* are overlaid passes through the drawing hole 36. At this point, the wet wipes 22*a* passing through the drawing hole 36 become thicker, but because the drawing hole forming member 32 is formed from an elastic member softer than the base plate 25, the hole size is arbitrarily expanded or contracted in accordance with the thickness of the wet wipes 22*a* passing through the drawing hole 36. Therefore, when, as shown, for example, in FIG. 14(*a*), a portion of the wet wipe 22*a* other than the dividing portion 4 passes, the hole size of the drawing hole 36 is d1 and when, as shown in FIG. 14(*b*), the dividing portion 4 of the wet wipe 22*a* passes, the hole size of the drawing hole 36 is deformed to become d2, which is larger than d1.

When the user completes the operation of drawing out the wet wipe 22*a*, the upward force is no longer provided from the wet wipe 22*a* to the drawing hole forming member 32. Thus, the drawing hole forming member 32 is elastically deformed in a C direction in FIG. 14(*c*) and the hole size of the drawing hole 36 becomes d3, which is smaller than d1. At this point, the hole size of the drawing hole 36 becomes d3 and is smaller than d1 or d2 when the wet wipe 22*a* is drawn out and therefore, frictional resistance is provided to the wet wipe 22*a* and a state (the so-called popup state) in which the tip of the wet wipe 22*a* against falling the wet wipe into the bag body 23 can be maintained.

Thus, according to the wet wipes package 21 in the second embodiment, the user can easily draw out the wet wipe 22*a* while maintaining a state without the wet wipe 2*a* being wrinkled by forming the pinching hole and the drawing hole 36 and troublesomeness when drawing out the wet wipe 2*a* and troublesomeness in use can significantly be reduced. Also, according to the wet wipes package 21 in the present embodiment, the drawing hole 36 is formed in the drawing hole forming member 32 made of an elastic material and the drawing hole 36 is configured to change in hole size in accordance with the thickness of the wet wipes 22*a* passing through the drawing hole 36 and therefore, the user can be made not to perceive changes in resistance caused by changes in thickness of the wet wipes 22*a* when the wet wipe 22*a* is drawn out and also the wet wipe 22*a* can be drawn out smoothly.

Incidentally, the shape of the drawing hole forming member 32 is not limited to the above shape and other configurations may also be adopted. For example, while the drawing hole forming member 32 shown in FIG. 10 is configured so that the first protruding portion 34 and the second protruding portion 35 are formed above and below the first recess 33 respectively, only the second protruding portion 35 may be formed below the first recess 33. In such a case, for example, the outside diameter of the first recess 33 may be formed slightly larger than the inside diameter of the mounting hole 28 so that the drawing hole forming member 32 is elastically deformed in a contracting direction when the drawing hole forming member 32 is locked into the mounting hole 28 and if the drawing hole forming member 32 can be locked into the mounting hole 28, any other method than the above method may be used for locking. If the above operation can be obtained, the configuration of the drawing hole forming member 32 may be different from the above one.

Figure 15:
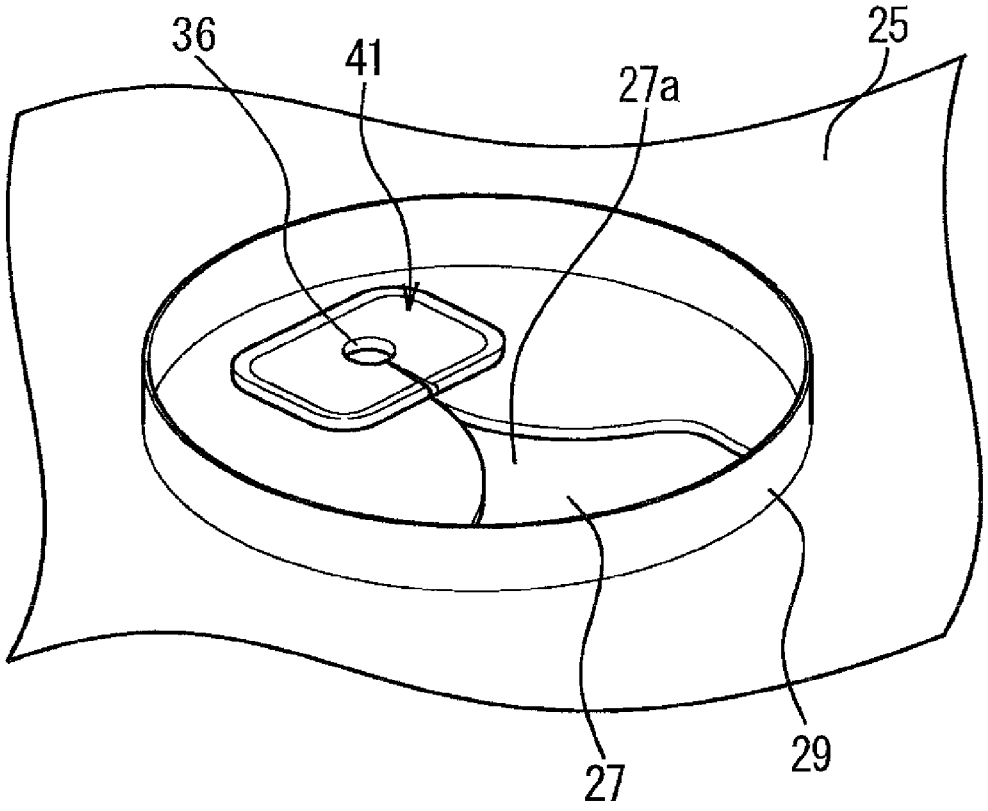
FIG. 15 is a perspective view showing the configuration of the drawing hole forming member according to a first modification of the present embodiment.

The wet wipes package 21 according to the second embodiment is configured so that the drawing hole forming member 32 as a different body from the base plate 25 is locked into the mounting hole 28, but as shown in FIG. 15, the drawing hole forming member 32 may integrally be molded with the base plate 25. A first modification of the wet wipes package according to the second embodiment will be described below based on FIG. 15. Also in the modification, the description of the same configuration portions as those described above is omitted and also the same reference numerals are used.

The wet wipes package 21 according to the first modification has a drawing hole forming portion 41 integrally molded with the base plate 25. The drawing hole forming portion 41 is formed from an elastic material softer than the base plate 25. Any elastic material that has been publicly known may be applied to the drawing hole forming portion 41, but in terms of ease of elastic deformation, the drawing hole forming portion 41 is preferably formed from an elastic material like a rubber material such as natural rubber and synthetic rubber, PP (polypropylene), PE (polyethylene), vinyl resin or the like. When synthetic rubber is used, it is preferable to use silicon rubber, urethane rubber or the like. As the method of integrally molding the drawing hole forming portion 41 with the base plate 25, any method that has been publicly known, for example, two-color molding and insert molding may arbitrarily selected and used.

Also when the drawing hole forming portion 41 is integrally molded with the base plate 25 as described above, the operation is the same as when the drawing hole forming member 32 as a different body is mounted on the based plate 25 described above in the second embodiment and the same effect can be achieved. Also in the present modification, the drawing hole forming portion 41 is integrally molded with the base plate 25 and thus, the thickness of the drawing hole forming portion 41 can be changed on the whole and so can be configured to facilitate elastic deformation.

Figure 16:
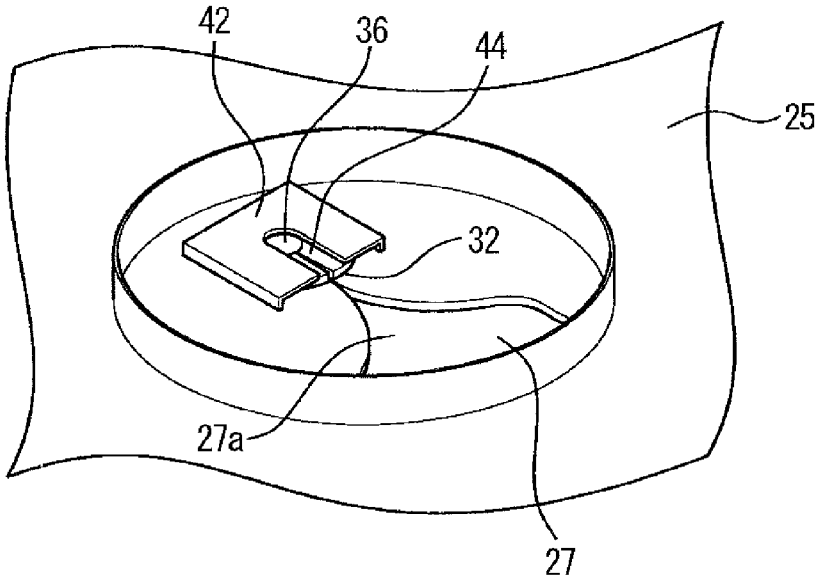
FIG. 16 is a perspective view showing the configuration of the drawing hole forming member according to a second modification of the present embodiment, wherein FIG. 16(*a*) is an external perspective view showing the external configuration of the relevant portion and FIG. 16(*b*) is an exploded perspective view showing the configuration of the relevant portion.
Figure 16:
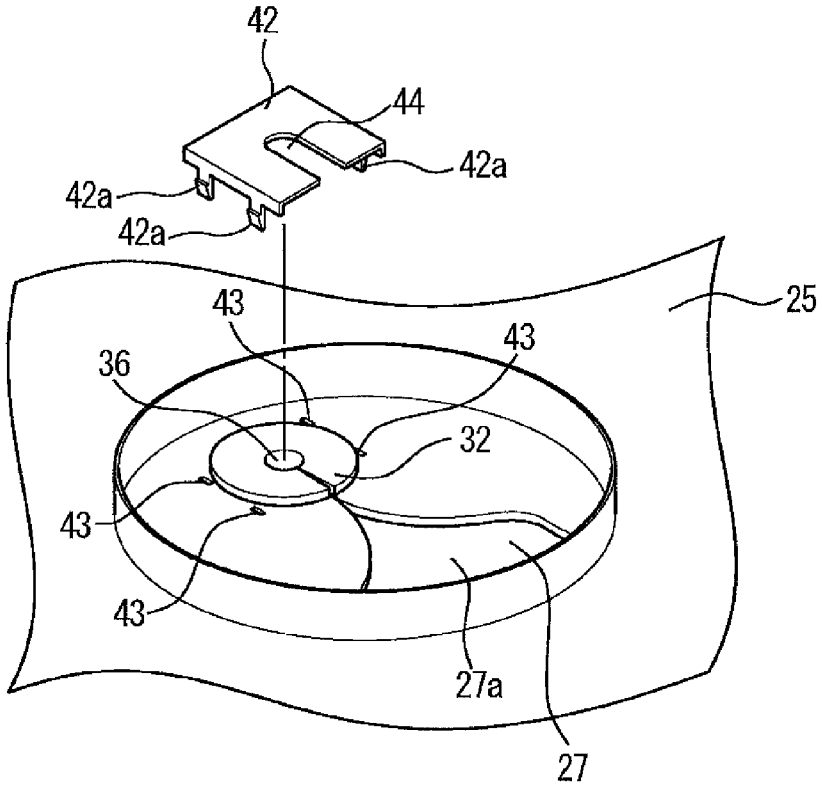

The drawing hole forming member 32 is configured to be fixed by the drawing hole forming member 32 as a different body from the base plate 25 being locked with respect to the base plate 25 in the second embodiment, but as shown in FIG. 16, a cover member 42 may be mounted like covering the perimeter of the drawing hole forming member 32. A second modification of the wet wipes package 21 according to the second embodiment will be described below based on FIG. 16. Also in the second modification, the description of the same configuration portions as those described above is omitted and also the same reference numerals are used.

As shown in FIG. 16(*a*), the wet wipes package 21 according to the second modification has the cover member 42 mounted like covering the drawing hole forming member 32 mounted on the base plate 25. The cover member 42 is used to position the drawing hole forming member 32. The cover member 42 is a member molded from a thermoplastic resin material such as polyethylene and polypropylene. Incidentally, the same material as that of the base plate 25 or a different material from that of the base plate 25 may be used for the cover member 42.

As shown in FIG. 16(*b*), the cover member 42 is formed in a shape capable of covering the drawing hole forming member 32 mounted in the mounting hole 28 and has a claw member 42*a* extending below formed at four locations. The base plate 25 has a through hole 43 through which the claw member 42*a* is inserted formed therein and the claw member 42*a* inserted through the through hole 43 is engaged below the base plate 25. The cover member 42 also has a notch 44 nicked in a width wider than the extension 27*a* and the drawing hole 36 when mounted on the base plate 25 formed therein. Though not shown, the cover member 42 has a positioning member capable of positioning the drawing hole forming member 32 formed therein. The positioning member is formed, for example, as a pin protruding downward from the back side of the cover member 42 and is configured to provide a force like pressing on the drawing hole forming member 32 from above the drawing hole forming member 32 when the cover member 42 is engaged and fixed to the base plate 25. The shape of the positioning member may be configured differently from the above as long as the drawing hole forming member 32 can be positioned.

The wet wipes package 21 according to the second modification has the same operation as described above and the same effect can be achieved. Also in the second modification, the cover member 42 covers the drawing hole forming member 32 and also positions the drawing hole forming member 32 and therefore, while drawing work of the wet wipe 22*a* is done, positioning between the position of the slit 37 of the drawing hole forming member 32 and the position of the extension 27*a* of the pinching hole 27 can be done precisely and also the positions can be maintained. Therefore, according to the wet wipes package 21 in the second modification, malfunctions like a case when the wet wipe 22*a* drawn from the pinching hole 27 does not move to the drawing hole 36 due to shifts between the slit 37 and the extension 27*a* of the pinching hole 27 after the use of the wet wipes package 21 for a long period of time can reliably be eliminated and user's operability can be maintained over a long period of time.

In the present embodiment, the drawing hole 36 is formed in a substantially circular shape in a plane view of the drawing hole forming member 32, but the shape is not limited to the above shape if the drawing hole 36 is elastically deformed easily when a wet wipe is drawn and the wet wipe can reliably be divided by the dividing portion. For example, the drawing hole forming member may have the shape shown in FIG. 17 or other shapes. The shapes of modifications of the drawing hole forming member will be described below. Up and down, and left and right when describing the configuration of a modification of the drawing hole forming member refer to the directions shown in FIG. 17.

Figure 17:
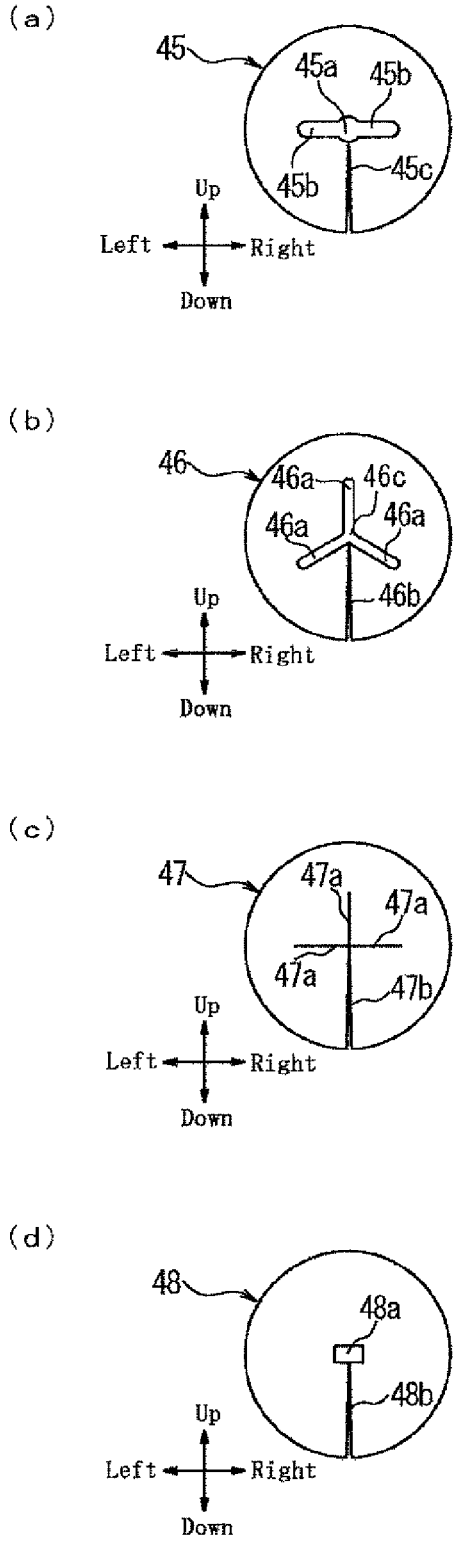
FIG. 17 is a diagram showing modifications of the drawing hole forming member according to the present embodiment.

As shown in FIG. 17(*a*), a drawing hole according to a first modification of a drawing hole forming member 45 has a center hole 45*a* in a substantially circular shape formed in the center and a long hole portion 45*b* is provided in a left and right direction of the center hole 45*a*. In addition, a slit 45*c* is provided below the center hole 45*a*. The slit is provided up to the periphery of the drawing hole forming member 45 and is formed in such a way that a wet wipe passing through the extension of the pinching hole passes through the slit 45*c* to reach the center hole 45*a* and the long hole portion 45*b* when mounted on the base plate. By configuring the drawing hole in this manner, the drawing hole forming member 45 is elastically deformed easily and the contact area with a wet wipe is increased so that the wet wipe can reliably be divided at the dividing portion.

As shown in FIG. 17(*b*), a drawing hole according to a second modification of a drawing hole forming member 46 is formed from three long hole portions 46*a*. These long hole portions 46*a* are formed in such a way that each long hole portion is positioned at intervals of 120°. In addition, a slit 46*b* is provided from a center portion 46*c* where the three long hole portions 46*a* intersect up to the periphery of the drawing hole forming member 46. Also by configuring the drawing hole in this manner, the drawing hole forming member 46 is elastically deformed easily and the contact area with a wet wipe is increased so that the wet wipe can reliably be divided at the dividing portion.

As shown in FIG. 17(*c*), a drawing hole according to a third modification of a drawing hole forming member 47 has three slits 47*a* formed by intersecting at intervals of 90° and a slit 47*b* extending up to the periphery of the drawing hole forming member 47 is formed like extending from the point where the three slits 47*a* intersect. If the drawing hole is formed as described above, the drawing hole forming member 47 can be made to be elastically deformed easily and further the cross section of a portion where a wet wipe passes through can be reduced and therefore, more appropriate resistance can be provided to the wet wipe passing through the slit 47*a* and the wet wipe can be divided at the dividing portion more reliably.

As shown in FIG. 17(*d*), a drawing hole 48*a* according to a fourth modification of a drawing hole forming member 48 is formed in a quadrangular shape. The drawing hole 48*a* may have a rectangular shape or a quadrate shape. In addition, below the drawing hole 48*a*, a slit 48*b* extending from the drawing hole 48*a* up to the periphery of the drawing hole forming member 48 is provided. Also by forming the drawing hole in the shape described above, the drawing hole forming member 48 as a whole is elastically deformed easily and the wet wipe passing through the drawing hole 48*a* can reliably be divided at the dividing portion.

Next, a third embodiment of a wet wipes package 51 according to the present invention will be described based on FIGS. 18 to 20. Also in the third embodiment, the description of the same configuration as that described above is omitted and also the same reference numerals are used. In the present embodiment, an example using a wet wipes folded body whose dividing portion is formed by overlaying and stacking edges of wet wipes in Z folding, WZ folding, or W folding will be described, but a wet wipes folded body of a different configuration may also be used.

Figure 18:
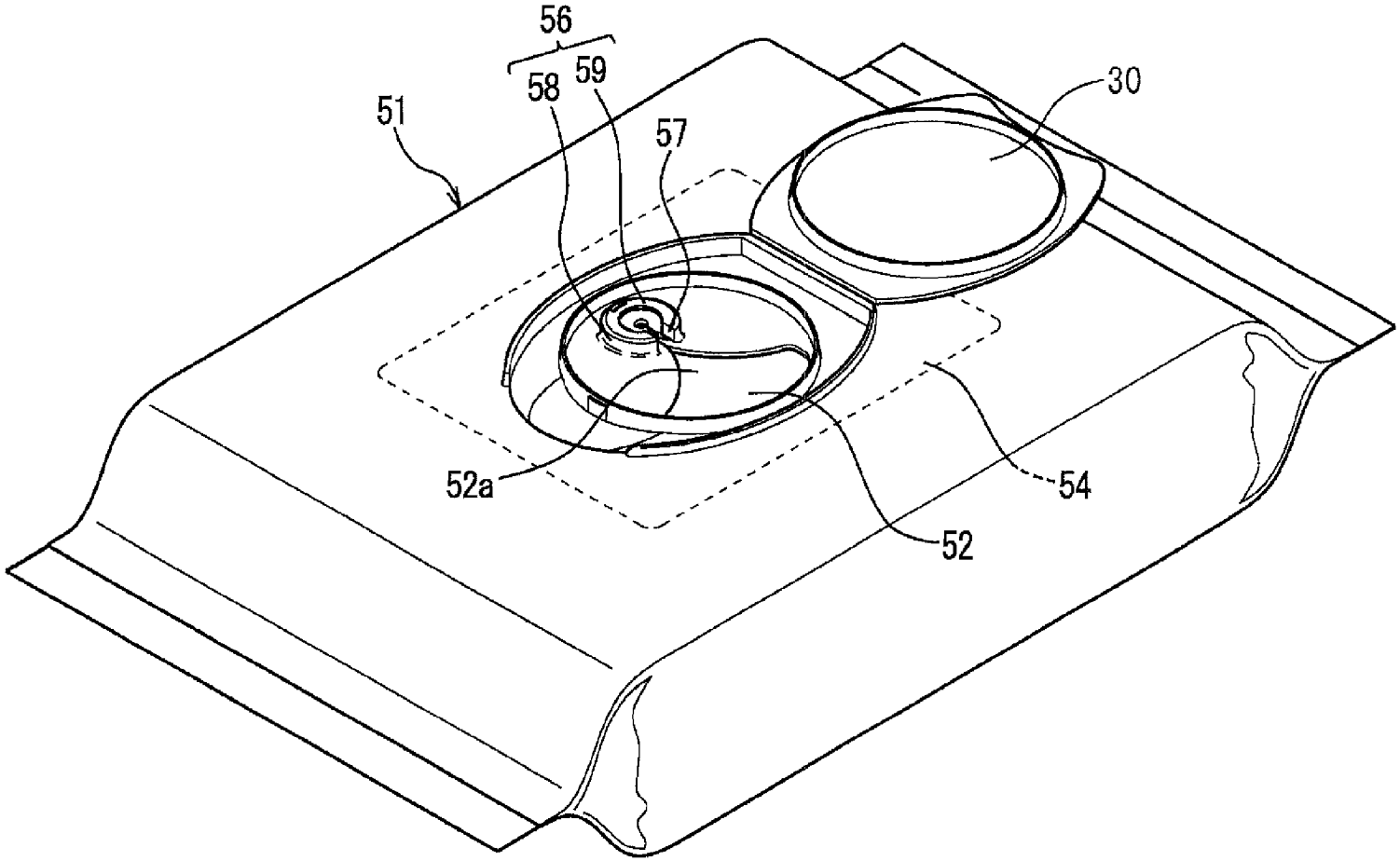
FIG. 18 is an external perspective view showing the external configuration of a wet wipes package according to a third embodiment of the present invention.
Figure 19:
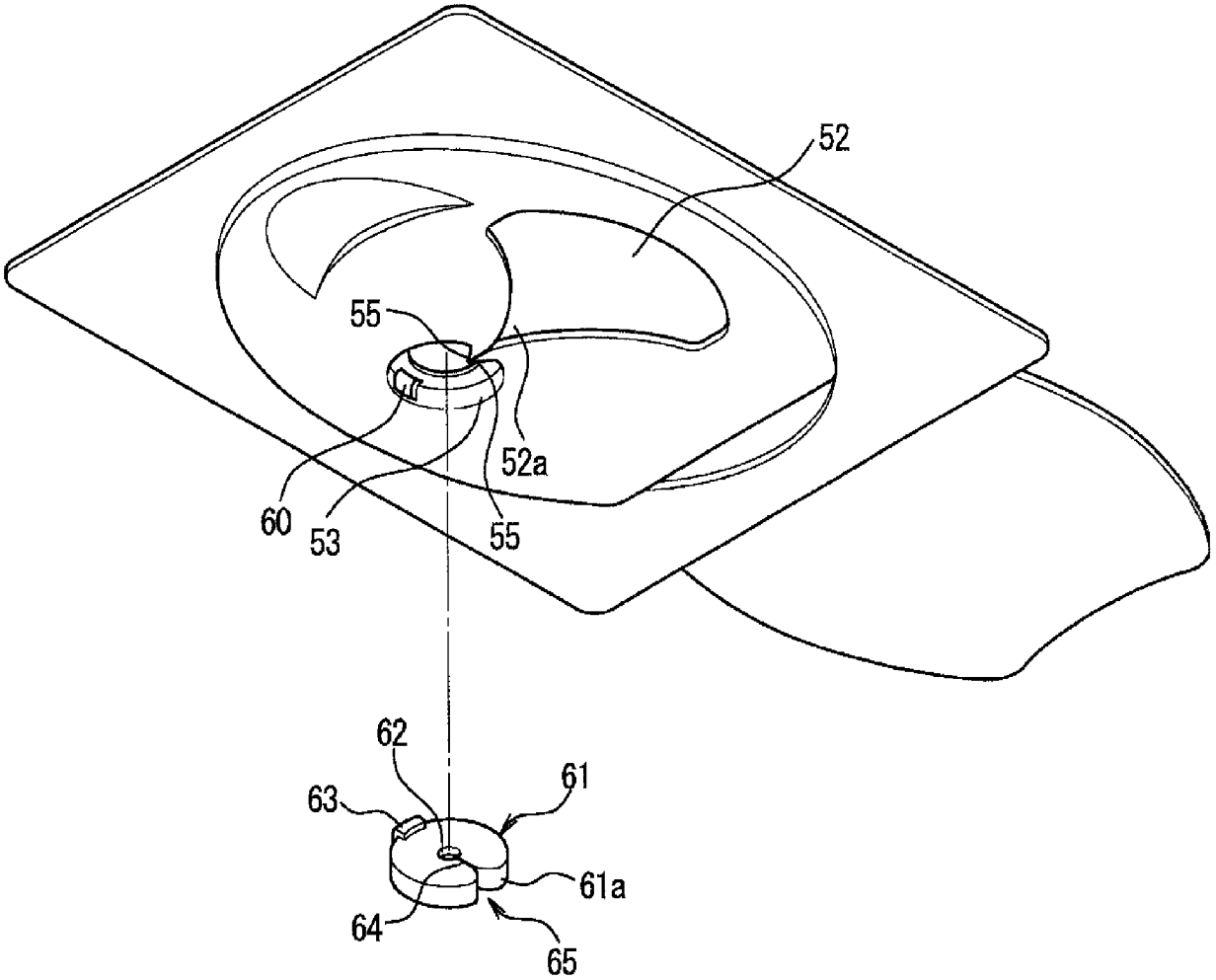
FIG. 19 is an exploded perspective view showing the configuration of a back side of the base plate.

As shown in FIGS. 18 and 19, the wet wipes package 51 according to the third embodiment has a pinching hole 52 and a mounting hole 53 formed in a base plate 54 and the pinching hole 52 and the mounting hole 53 are configured to be linked by an extension 52*a* of the pinching hole 52. The mounting hole 53 has a protruding portion 55 protruding toward the inner side of the mounting hole 53 formed therein. The protruding portion 55 is used to prevent, when a drawing hole forming member described later is mounted in the mounting hole 53, the wet wipe 22*a* passing through a drawing hole 62 formed in the drawing hole forming member from moving in a direction of the pinching hole 52.

A cover portion 56 is formed around the mounting hole 53 like covering the mounting hole 53. The cover portion 56 is configured by upright providing a wall-like portion 58 like surrounding the mounting hole 53 excluding a portion (hereinafter, this portion will be called an opening 57) where the extension 52*a* is formed and forming a ceiling portion 59 formed by extending toward the inside diameter of the mounting hole 53 from the top end of the wall-like portion 58. The ceiling portion 59 has an inside diameter formed so as to be smaller than the outside diameter of a drawing hole forming member described later and is configured so that a drawing hole forming member 61 locked on the undersurface side does not penetrate upward. In addition, the cover portion 56 has a fixing hole 60 formed in a position opposite to the opening 57 across the mounting hole 53. The fixing hole 60 is formed in a size allowing a fixing piece 63 described later which is formed in the drawing hole forming member 61 to be locked.

Figure 20:
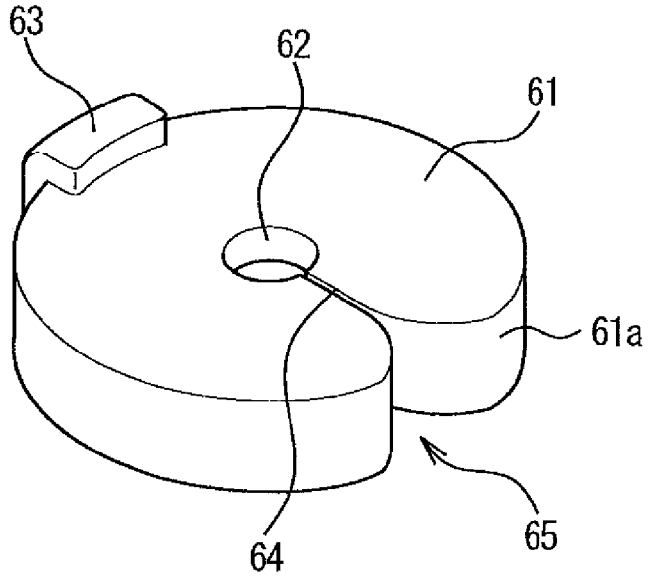
FIG. 20 is an external perspective view showing the configuration of a drawing hole forming member, wherein FIG. 20(*a*) is an external perspective view from above and FIG. 20(*b*) is an external perspective view from below.
Figure 20:
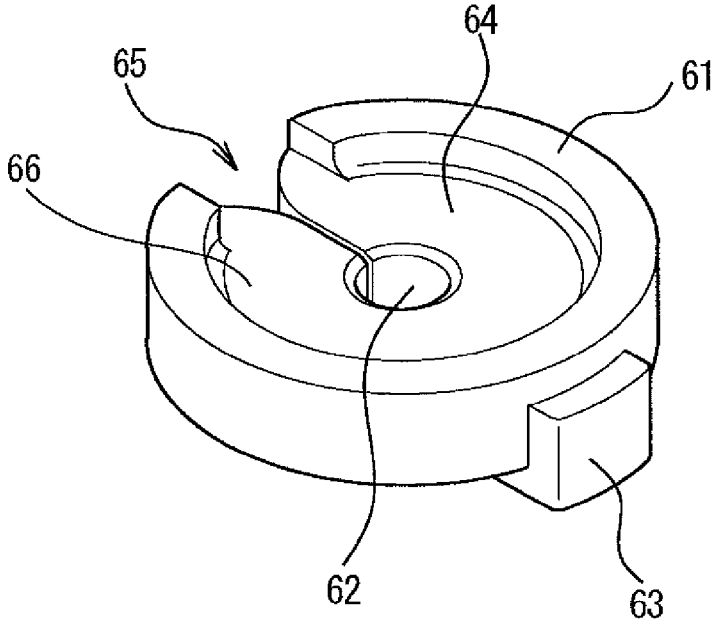

As shown in FIGS. 19 and 20, the drawing hole forming member 61 constitutes a drawing hole forming member of the present invention and is formed from an elastic material softer than the base plate 54. Any elastic material that has been publicly known may be applied as the elastic material constituting the drawing hole forming member 61, but in terms of ease of elastic deformation, the drawing hole forming member 61 is preferably formed from an elastic material like a rubber material such as natural rubber and synthetic rubber, PP (polypropylene), PE (polyethylene), vinyl resin or the like. When synthetic rubber is used, it is preferable to use silicon rubber, urethane rubber or the like.

The drawing hole forming member 61 has the drawing hole 62 formed substantially in the center thereof and has the fixing piece 63 and a slit 64 formed in positions opposite to each other across the drawing hole 62. The fixing piece 63 is formed in a shape allowing to be locked into the fixing hole 60 of the cover portion 56 and is formed in the present embodiment, as shown in FIGS. 19 and 20(*a*), like protruding from the drawing hole forming member 61. The slit 64 is provided from the drawing hole 62 toward the outer circumference thereof. A notch 65 formed to avoid interference with the protruding portion 55 is formed in a position where the slit 64 and a periphery 61*a* intersect. As shown in FIG. 20(*b*), a recess 66 is formed on the undersurface side of the drawing hole forming member 61 so that the drawing hole forming member 61 in a location where the drawing hole 62 is formed becomes thinner.

Thus, according to the wet wipes package 51 in the third embodiment, the user can easily draw out the wet wipe while maintaining a state without the wet wipe being wrinkled by forming the pinching hole 52 and the drawing hole 62 and troublesomeness when drawing out the wet wipe and troublesomeness in use can significantly be reduced. Also, according to the wet wipes package 51 in the present embodiment, the drawing hole 62 is formed in the drawing hole forming member 61 made of an elastic material and the drawing hole 62 is configured to change in hole size in accordance with the thickness of the wet wipes passing through the drawing hole 62 and therefore, the user can be made not to perceive changes in resistance caused by changes in thickness of the wet wipes when the wet wipe is drawn out and also the wet wipe can be drawn out smoothly.

Also according to the wet wipes package 51 in the third embodiment, in addition to the above effects described in the first and second embodiments, the fixing piece 63 is formed in the drawing hole forming member 61 and the fixing hole 60 is formed in the cover portion 56 and therefore, the drawing hole forming member 61 can be locked into the cover portion 56 only by locking the fixing piece 63 into the fixing hole 60. Therefore, according to the wet wipes package 51 in the third embodiment, work efficiency in mounting or the like during production can be improved.

In addition, the drawing hole forming member 61 can be positioned by mounting and fixing the drawing hole forming member 61 by locking the fixing piece 63 of the drawing hole forming member 61 into the fixing hole 60 of the cover portion 56. Thus, positioning between the position of the slit 64 of the drawing hole forming member 61 and the position of the extension 52*a* of the pinching hole 52 can be done precisely and also the positions can be maintained. Therefore, according to the wet wipes package 51 in the third embodiment, malfunctions like a case when the wet wipe drawn from the pinching hole 52 does not move to the drawing hole 62 due to shifts between the slit 64 and the extension 52*a* of the pinching hole 52 after the use of the wet wipes package 51 for a long period of time can reliably be eliminated and user's operability can be maintained over a long period of time.

Figure 21:
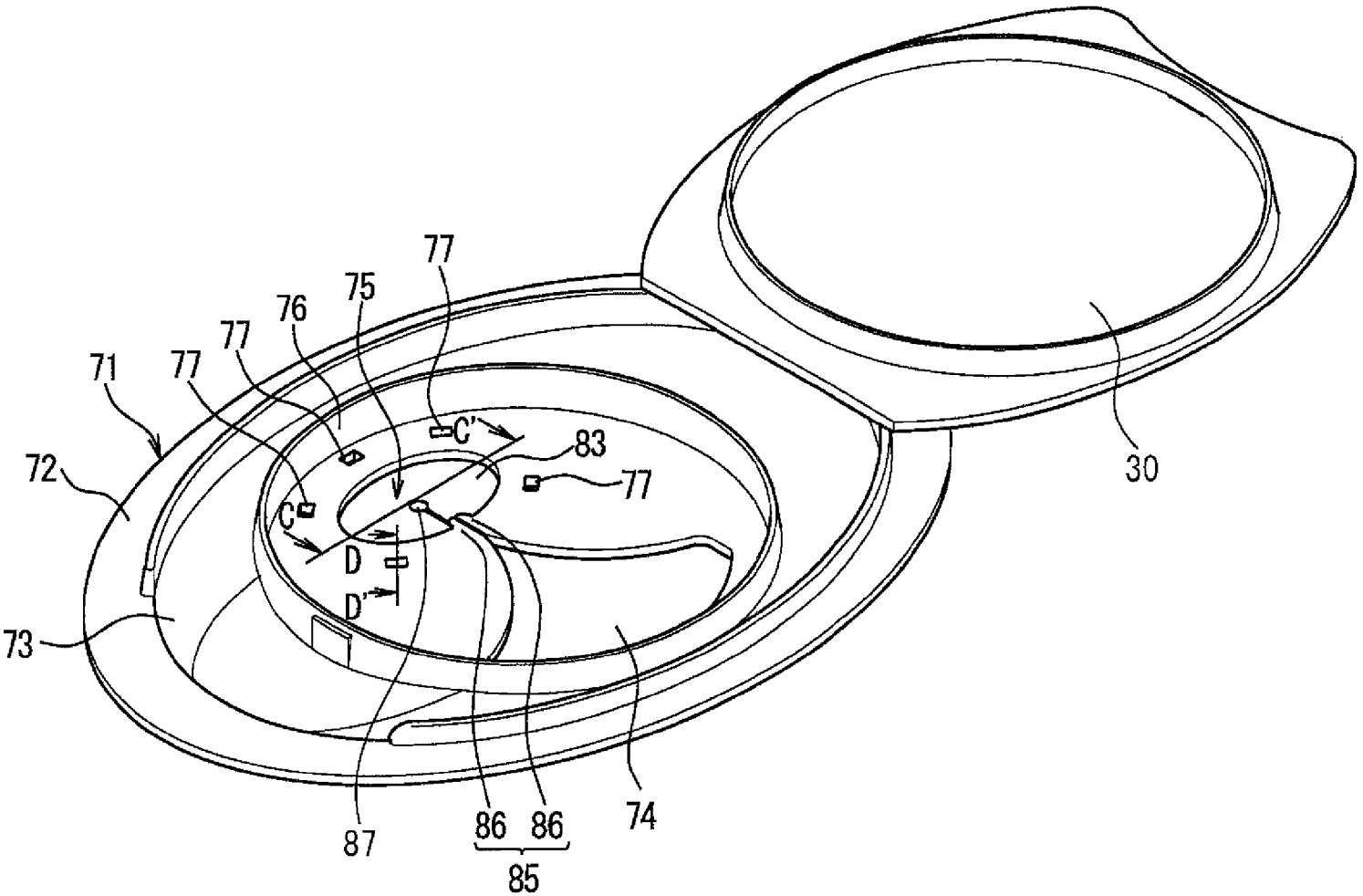
FIG. 21 is an external perspective view showing the external configuration of a base plate applied to a wet wipes package according to a fourth embodiment of the present invention.
Figure 22:
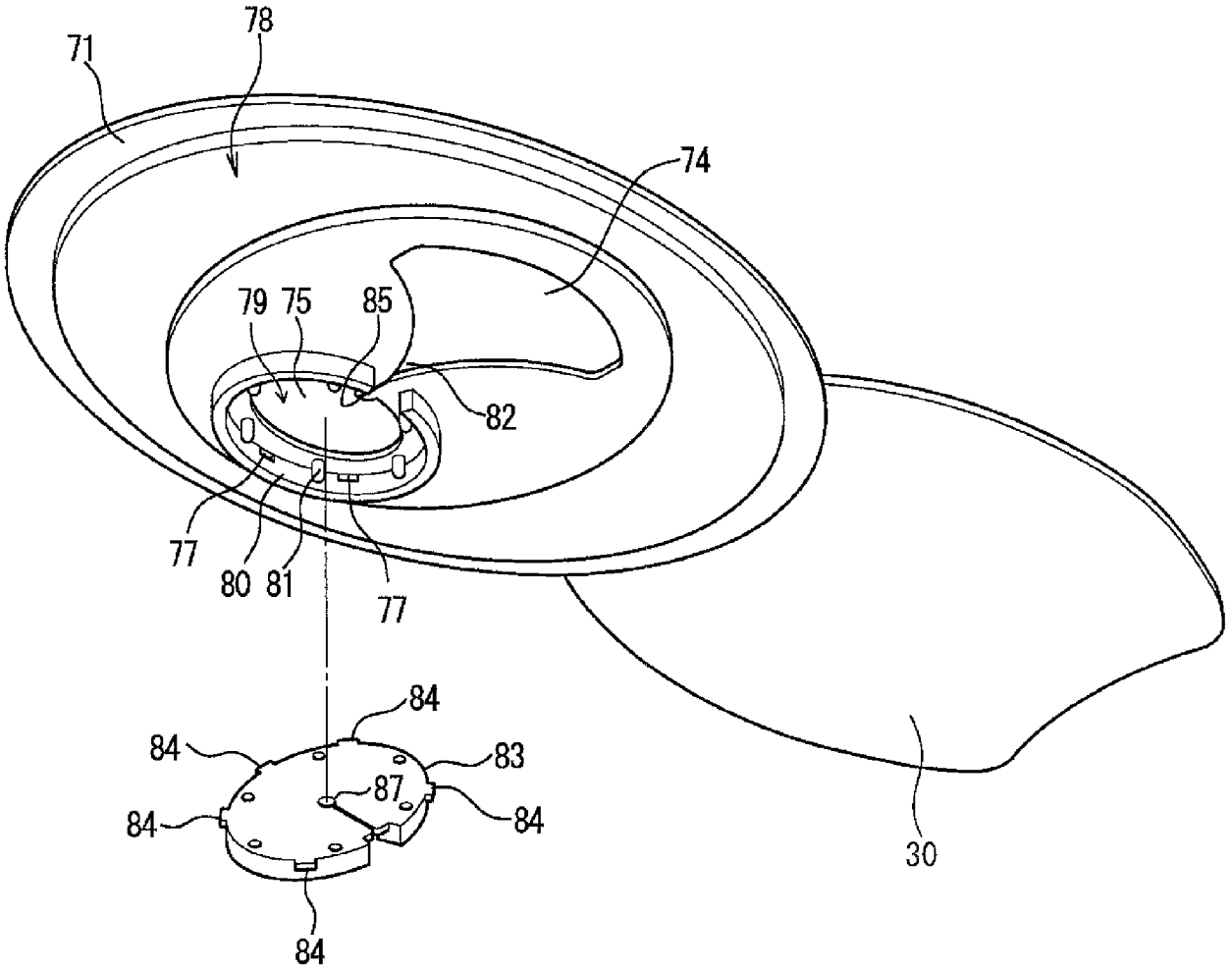
FIG. 22 is an exploded perspective view showing the configuration of the back side of the base plate.
Figure 23:
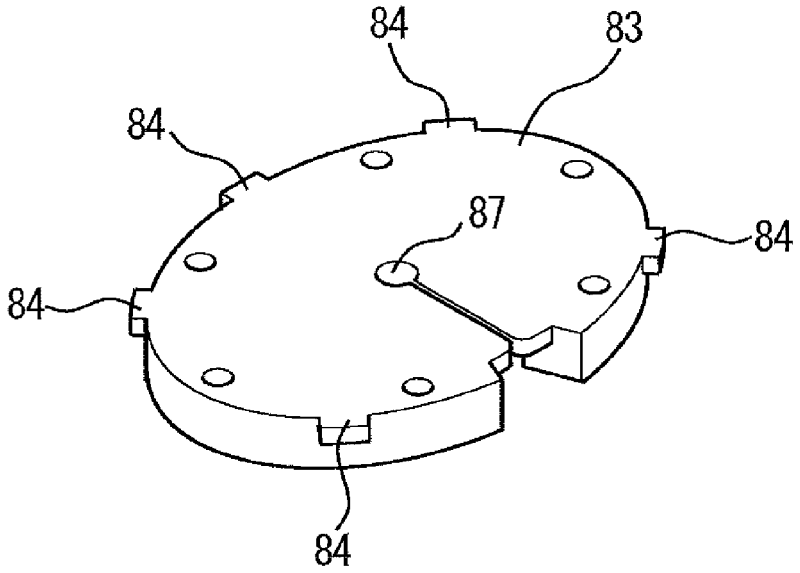
FIG. 23 is an external perspective view showing the configuration of a drawing hole forming member, wherein FIG. 23(*a*) is an external perspective view from above and FIG. 23(*b*) is an external perspective view from below.
Figure 23:
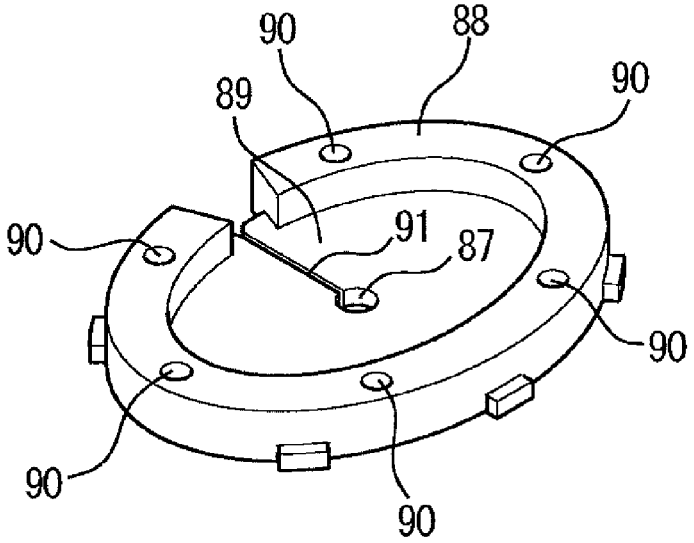
Figure 24:
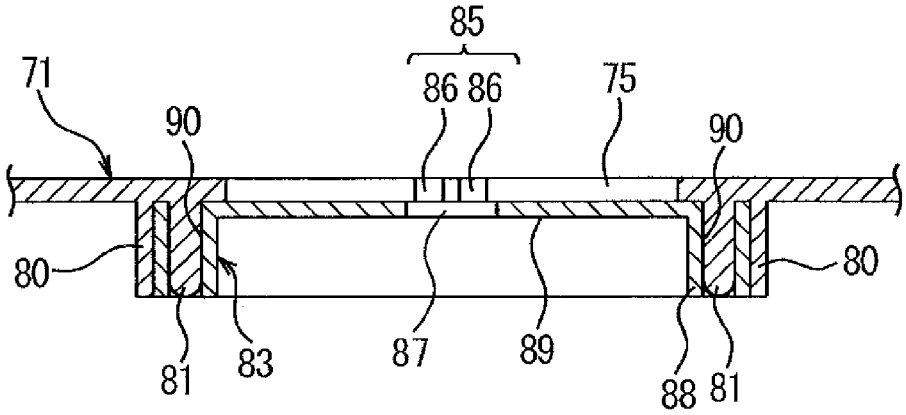
FIG. 24(*a*) is a sectional view taken along a C-C' line of FIG. 21 and FIG. 24(*b*) is a sectional view taken along a D-D' line of FIG. 21.
Figure 24:
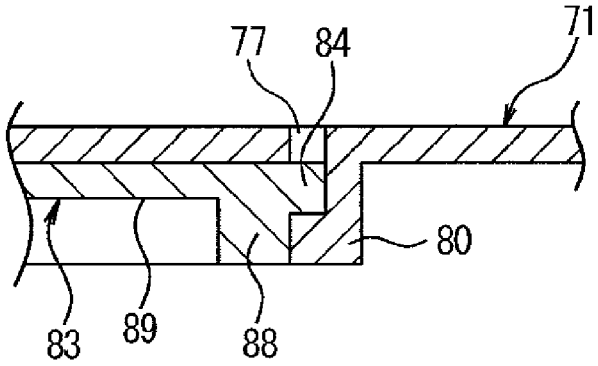

Next, a fourth embodiment of a wet wipes package according to the present invention will be described based on FIGS. 21 to 24. FIG. 21 is an external perspective view showing the external configuration of a base plate 71 applied to a wet wipes package according to the fourth embodiment of the present invention, FIG. 22 is an exploded perspective view showing the configuration of the back side of the base plate 71, FIG. 23 is an external perspective view showing the configuration of a drawing hole forming member 83, wherein FIG. 20(*a*) is an external perspective view from above and FIG. 20(*b*) is an external perspective view from below, and FIG. 24 shows sectional view of the base plate 71 according to the forth embodiment of the present invention, wherein FIG. 24(*a*) is a sectional view taken along a C-C' line of FIG. 21 and FIG. 24(*b*) is a sectional view taken along a D-D' line of FIG. 21. In the fourth embodiment, the configuration of the bag body and wet wipes folded body is the same as that described in the first embodiment and the configuration of the lid is the same as that described in the second embodiment and thus, the description and illustration thereof are omitted. In the present embodiment, a wet wipes folded body in which the dividing portion is formed by overlaying and stacking edges of wet wipes in Z folding, WZ folding, or W folding may be used or a wet wipes folded body in which a partially continuous portion like perforation is formed may be used.

The base plate 71 is formed from a thermoplastic resin material such as polyethylene and polypropylene or the like, and molded by a molding method that has been publicly known. As shown in FIG. 21, the base plate 71 is formed in an elliptic shape and has a welding surface 72 to mount the base plate 71 on a bag body by an arbitrary method such as hot melt formed on the outer edge. In addition, a recess 73 depressed from the welding surface 72 is formed on the inner side of the welding surface 72. The recess 73 has a pinching hole 74 and a hole 75 formed therein and an upper wall portion 76 is formed like surrounding the pinching hole 74 and the hole 75. In addition, the recess 73 has a plurality of locking holes 77 formed around the opening 75.

As shown in FIGS. 22 and 23, with the formation of the recess 73 on the upper surface side, a portion 78 where the recess 73 is formed as if to protrude like a prominence on the undersurface side of the base plate 71. The pinching hole 74 is formed by penetrating the base plate 71 and so can be recognized also from the undersurface of the base plate 71. Further, a mounting portion 79 to mount and fix the drawing hole forming member 83 as a drawing hole forming portion is formed at the tip of an extension 82 of the pinching hole 74. The mounting portion 79 includes a lower wall portion 80 and a plurality of bosses 81. The lower wall portion 80 is formed in an elliptic shape like surrounding the opening 75 excluding a location where the extension 82 is formed. In addition, the lower wall portion 80 has the locking hole 77 formed up to a predetermined distance from the undersurface of the base plate 71. The locking hole 77 is formed so that the upper surface of the base plate 71 and the inner circumferential surface of the lower wall portion 80 are linked and formed in a size allowing a rib 84 of the drawing hole forming member 83 mounted on the undersurface side of the base plate 71 to be locked. As described above, the locking hole 77 is formed at a plurality of locations corresponding to the ribs 84 of the drawing hole forming member 83.

The opening 75 is formed in a substantially elliptic shape and has a protruding portion 85 protruding toward the inner side of the opening 75 formed in a location connected to the extension 82 of the pinching hole 74. The protruding portion 85 is formed of two protrusions 86. These two protrusions 86 are used to prevent a wet wipe from moving from a drawing hole 87 to the pinching hole 74 when the wet wipe is drawn from the drawing hole 87 formed in the drawing hole forming member 83. The opening 75 is preferably formed in such a way that the upper end surface of the drawing hole forming member 83 is exposed. By forming the opening 75 as described above, the drawing hole forming member 83 is elastically deformed more easily when a force is applied to the drawing hole forming member 83 like when a wet wipe is drawn so that the wet wipe can be drawn more smoothly with a soft touch.

In the fourth embodiment, the protrusion 86 of the protruding portion 85 is formed in a curved shape, but the shape of the protrusion 86 may be a pointed shape or other shapes. The opening 75 is formed in an elliptic shape in the present embodiment, but the opening 75 may have a different shape like, for example, a circular shape.

The drawing hole forming member 83 constitutes a drawing hole forming portion and is formed from an elastic material softer than the base plate 71. Any elastic material that has been publicly known may be applied to the drawing hole forming member 83, but in terms of ease of elastic deformation, the drawing hole forming member 83 is preferably formed from an elastic material like a rubber material such as natural rubber and synthetic rubber, PP (polypropylene), PE (polyethylene), vinyl resin or the like. When synthetic rubber is used, it is preferable to use silicon rubber, urethane rubber or the like.

As shown in FIGS. 22 and 23, the drawing hole forming member 83 has an external shape formed in an elliptic shape and has a plurality of the ribs 84 formed in an upper part of the outer circumferential surface like protruding toward the outer circumferential side. The rib 84 is formed in positions corresponding to the locking hole 77 formed in the mounting portion 79 of the base plate 71 and the five ribs 84 are formed in the present embodiment. As shown in FIG. 23(*b*), the drawing hole forming member 83 is formed in such a way that an edge portion 88 is thicker than a center portion 89 formed on the center side of the edge portion 88. In addition, a plurality of through holes 90 is formed in the edge portion 88. The through holes 90 are formed in positions corresponding to the plurality of bosses 81 formed in the base plate 71 and the six through holes 90 are formed in the present embodiment. The through hole 90 is formed in a size equal to the inside diameter of the boss 81 or smaller so that the drawing hole forming member 83 is less likely to come off. As shown in FIG. 23(*b*), a portion where a slit 91 described later is formed is formed thin up to the outer circumferential edge.

The drawing hole forming member 83 has the drawing hole 87 formed in the center portion 89 by penetrating the drawing hole forming member 83 and the slit 91 is formed between the drawing hole 87 and the outer circumferential edge of the drawing hole forming member 83. The slit 91 is formed in a position that continues to a slit-like gap formed in the extension 82 of the pinching hole 74 when the drawing hole forming member 83 is mounted on the mounting portion 79 of the base plate 71.

FIG. 24 shows sectional views of the base plate 71, and FIG. 24(*a*) is a sectional view taken along a C-C' line of FIG. 21 and FIG. 24(*b*) is a sectional view taken along a D-D' line of FIG. 21. When, as shown in FIG. 24(*a*), the drawing hole forming member 83 is mounted on the mounting portion 79 of the base plate 71, the boss 81 is inserted into the through hole 90 of the drawing hole forming member 83 and, as shown in FIG. 24(*b*), the rib 84 of the drawing hole forming member 83 is locked into the locking hole 77 to be fixed. Also, as shown in FIG. 24, the protruding portion 85 formed in the base plate 71 is configured to be positioned above the upper surface of the drawing hole forming member 83 mounted on the undersurface side of the base plate 71.

Thus, in a wet wipes package according to the fourth embodiment, a drawing hole forming member is reliably positioned with respect to a base plate by inserting each corresponding boss into each of a plurality of through holes and further locking each corresponding rib into each of a plurality of locking holes. Particularly in the present embodiment, while an extension of a pinching hole formed in the base plate and a slit formed in the drawing hole forming member need to be arranged so that a space formed in the extension allowing a wet wipe to move and a space formed in the slit allowing a wet wipe to move are continuous, the precision of positioning is enormously improved by the insertion of the boss into each through hole and locking of the rib into each locking hole.

Therefore, according to a wet wipes package in the fourth embodiment, the user can easily draw out a wet wipe while maintaining a state without the wet wipe being wrinkled by forming a pinching hole and drawing hole and troublesomeness when drawing out the wet wipe and troublesomeness in use can significantly be reduced. In addition, the drawing hole is formed in the drawing hole forming member made of an elastic material and the drawing hole is configured to change in hole size in accordance with the thickness of the wet wipes passing through the drawing hole and therefore, the user can be made not to perceive changes in resistance caused by changes in thickness of the wet wipes when the wet wipe is drawn out and also the wet wipe can be drawn out smoothly.

Also in a wet wipes package according to the fourth embodiment, when a drawing hole forming member is mounted on a base plate, a boss of the base plate is inserted into a through hole of the drawing hole forming member and further a rib of the drawing hole forming member is locked into a locking hole. Further, the drawing hole forming member is formed from a material that is elastically deformed easily and the inside diameter of the through hole is formed smaller than the outside diameter of the boss. Therefore, according to a wet wipes package in the fourth embodiment, the drawing hole forming member can be mounted and fixed to the base plate reliably only by press-fitting the boss into the through hole and the drawing hole forming member can reliably be prevented from falling when a downward force is applied by further locking the rib of the drawing hole forming member into the locking hole of the base plate so that troublesomeness when, for example, the user needs to remount the drawing hole forming member that has fallen can be reduced.

Also according to a wet wipes package in the fourth embodiment, a drawing hole forming member can be mounted on a base plate by the simple method described above and a mounting hole forming member can be positioned by inserting a boss into a through hole and therefore, efficiency of mounting work during production can be improved so that production efficiency of a wet wipes package can further be improved.

Figure 25:
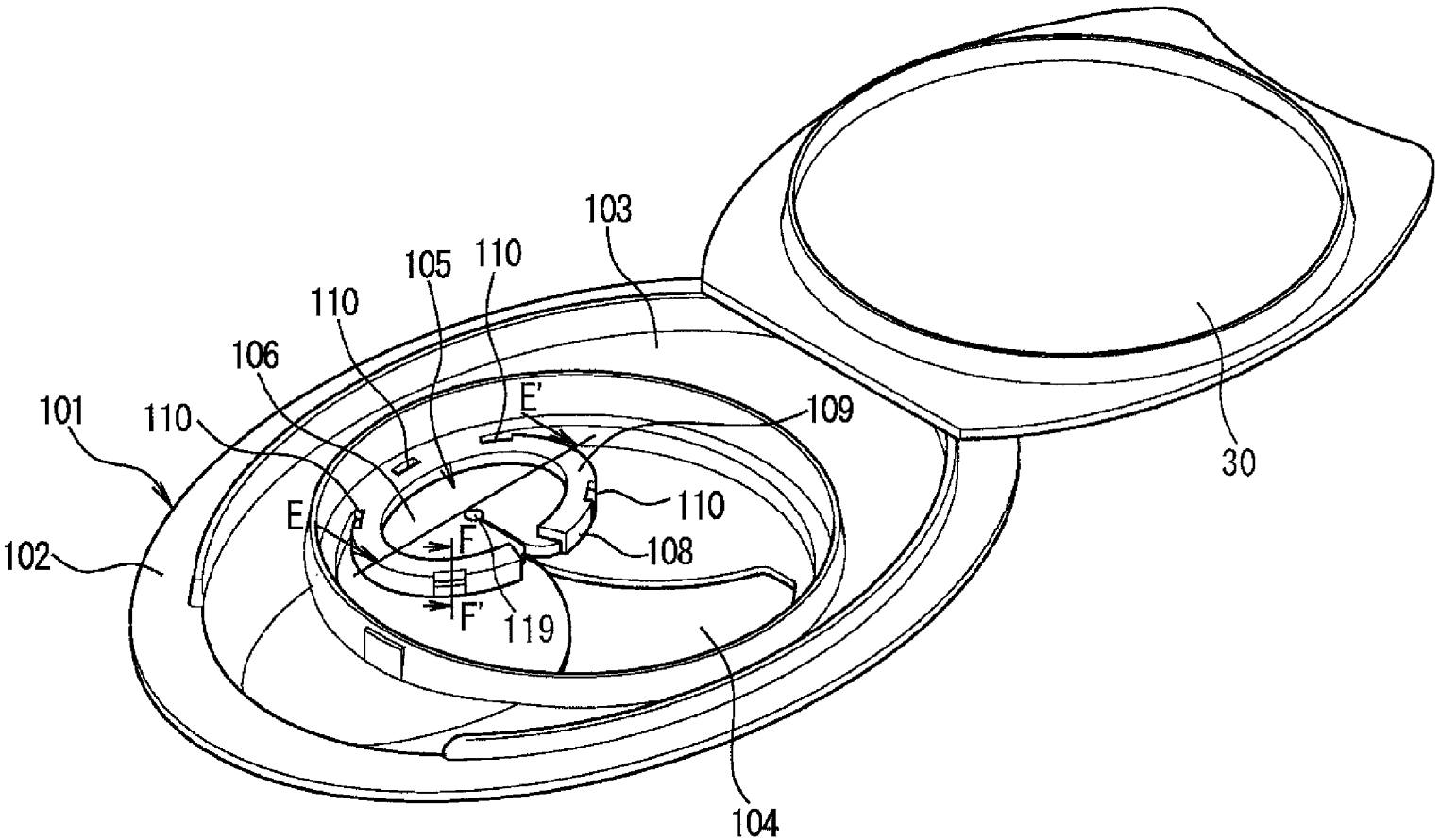
FIG. 25 is an external perspective view showing the external configuration of a base plate applied to a wet wipes package according to a fifth embodiment of the present invention.
Figure 26:
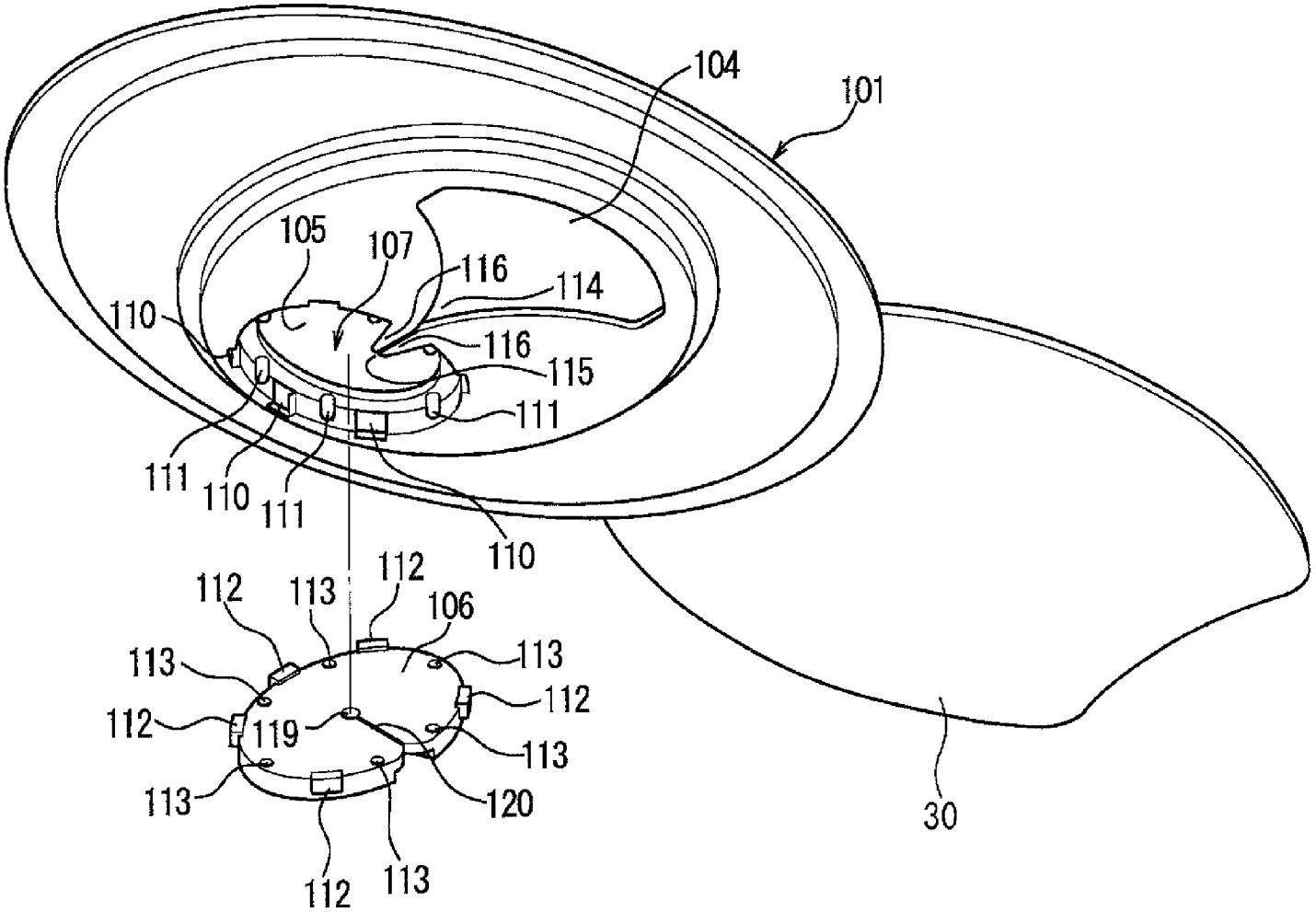
FIG. 26 is an exploded perspective view showing the configuration of the back side of the base plate.
Figure 27:
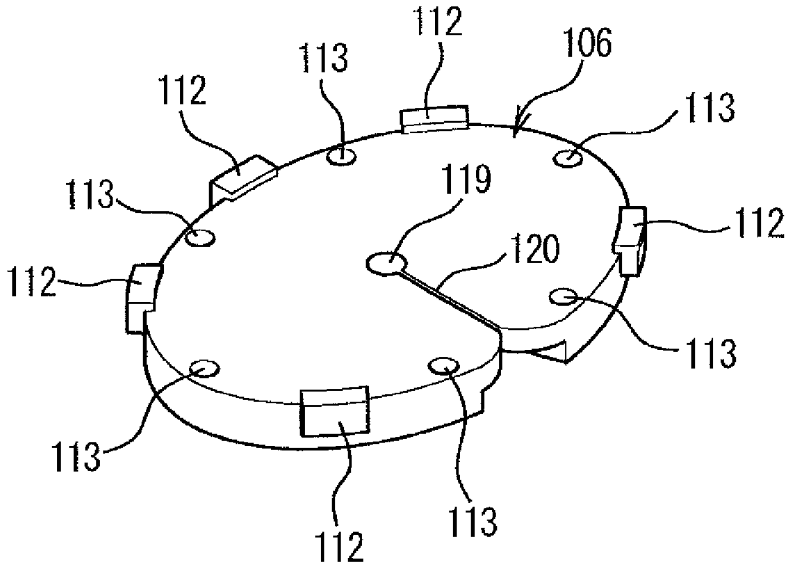
FIG. 27 is an external perspective view showing the configuration of a drawing hole forming member, wherein FIG. 27(*a*) is an external perspective view from above and FIG. 27(*b*) is an external perspective view from below.
Figure 27:
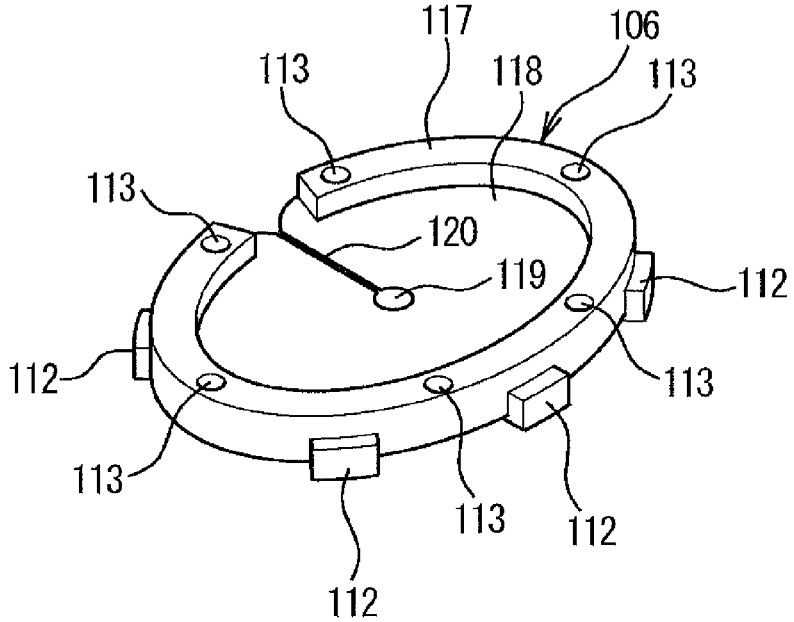
Figure 28:
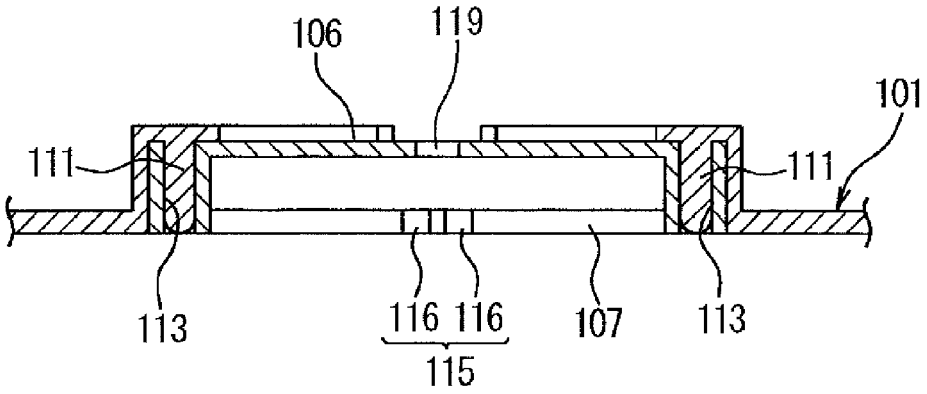
FIG. 28(*a*) is a sectional view taken along an E-E' line of FIG. 25 and FIG. 28(*b*) is a sectional view taken along an F-F' line of FIG. 25.
Figure 28:
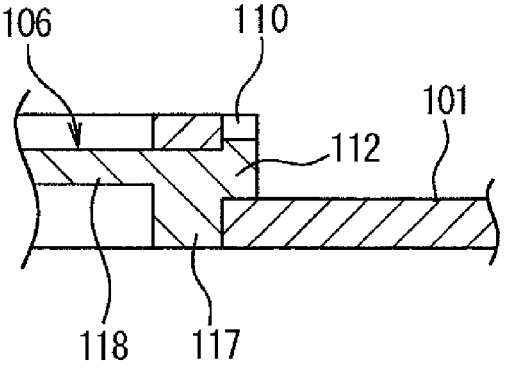

Next, a fifth embodiment of a wet wipes package of the present invention will be described based on FIGS. 25 to 28. FIG. 25 is an external perspective view showing the external configuration of a base plate applied to a wet wipes package according to the fifth embodiment of the present invention, FIG. 26 is an exploded perspective view showing the configuration of the back side of the base plate, FIG. 27 is an external perspective view showing the configuration of a drawing hole forming member, wherein FIG. 27(*a*) is an external perspective view from above and FIG. 27(*b*) is an external perspective view from below, and FIG. 28 is a sectional view of the base plate, wherein FIG. 28(*a*) is a sectional view taken along an E-E' line of FIG. 25 and FIG. 28(*b*) is a sectional view taken along an F-F' line of FIG. 25. Also in the present embodiment, the configuration of the bag body and wet wipes folded body is the same as that described in the first embodiment and the configuration of the lid is the same as that described in the second embodiment and thus, the description and illustration thereof are omitted. Also in the present embodiment, a wet wipes folded body in which the dividing portion is formed by overlaying and stacking edges of wet wipes in Z folding, WZ folding, or W folding may be used or a wet wipes folded body in which a partially continuous portion like perforation is formed may be used.

As shown in FIGS. 25 and 26, a base plate 101 is formed in an elliptic shape and has a welding surface 102 to mount the base plate 101 on a bag body by an arbitrary method such as hot melt formed on the outer edge. A recess 103 depressed from the welding surface 102 is formed on the inner side of the welding surface 102. In the recess 103, a pinching hole 104, an opening 105 constituting a drawing hole forming portion, and a mounting portion 107 on which a drawing hole forming member 106 described later is mounted are formed and an upper wall portion 108 is formed like surrounding the mounting portion 107 and the perimeter of the opening 105 and the mounting portion 107.

The mounting portion 107 is used to mount the drawing hole forming member 106 described later and includes a sidewall portion 108 provided upright around the opening 105, a horizontal wall portion 109 extending by a predetermined dimension to the inner side from the upper end of the sidewall portion 108, a locking hole 110 formed in the sidewall portion 108 and the horizontal wall portion 109, and a plurality of bosses 111 formed by extending downward from the undersurface of the horizontal wall portion 109.

The sidewall portion 108 is formed like surrounding the opening 105 excluding a portion where an extension portion of the mounting portion 107 is formed. The sidewall portion 108 is formed to have an inside diameter equal to the inside diameter of the opening 105 and is formed to have an inside diameter equal to the outside diameter of the drawing hole forming member 106 or smaller than the outside diameter of the drawing hole forming member 106. The horizontal wall portion 109 is used to prevent the drawing hole forming member 106 mounted on the mounting portion 107 from slipping upward and is formed by extending by a predetermined dimension toward the inside diameter side of the opening 105 from the upper end of the sidewall portion 108. In this case, the horizontal wall portion 109 is preferably formed so as to cover only a portion of the upper surface of the mounted drawing hole forming member 106. By forming the horizontal wall portion 109 as described above, a state allowing the drawing hole forming member 106 to be elastically deformed easily can be maintained when a wet wipe is drawn out.

The locking hole 110 is provided at a plurality of locations of the sidewall portion 108. The locking hole 110 according to the present embodiment is formed by cutting out the sidewall portion 108 by providing a notch equal to the thickness of the sidewall portion 108 or more between the undersurface side of the base plate 101 and the upper end surface of the horizontal wall portion 109. The locking hole 110 is formed in a size allowing a rib 112 of the drawing hole forming member 106 mounted to be locked. Incidentally, the configuration of the locking hole 110 shown in the present embodiment is only an example and any configuration in which the rib 112 of the drawing hole forming member 106 can be locked may also be adopted.

The boss 111 is used to mount and fix the drawing hole forming member 106 to the mounting portion 103 by being inserted into a through hole 113 formed in the drawing hole forming member 106. In the present embodiment, the six bosses 111 are formed at predetermined intervals from the undersurface of the horizontal wall portion 109. The boss 111 is formed to have an outside diameter larger than the through hole 113 of the drawing hole forming member 106.

The opening 105 is formed in a substantially elliptic shape and has a protruding portion 115 protruding toward the inner side of the opening 105 in a location connected to an extension 114 constituting the pinching hole 104. The protruding portion 115 is formed of two protrusions 116 and in the present embodiment, these protrusions 116 are formed in a shape with a pointed tip. Incidentally, the tip of the protrusion 116 is formed in a pointed shape in the present embodiment, but these protrusions 116 may have a different shape if a wet wipe drawn from a drawing hole 119 formed in the drawing hole forming member 106 can be prevented from moving to the pinching hole 104.

The drawing hole forming member 106 constitutes a drawing hole forming portion and is formed from an elastic material softer than the base plate 101. The drawing hole forming member 106 similar to one in the fourth embodiment described above is arbitrarily applied and is formed by a method that has been publicly known.

As shown in FIGS. 26 and 27, the drawing hole forming member 106 has an external shape formed in an elliptic shape and has a plurality of the ribs 112 formed in an upper part of the outer circumferential surface. In the present embodiment, the rib 112 is formed at five locations and each of the ribs 112 is formed slightly higher than the upper surface of the drawing hole forming member 106. In addition, these ribs 112 are formed slightly on the inside diameter side from the outer circumferential surface of the drawing hole forming member 106.

As shown in FIG. 27(*b*), the drawing hole forming member 106 is formed in such a way that an edge portion 117 is thicker than a center portion 118 formed on the center side of the edge portion 117. In addition, the six through holes 113 are formed in the edge portion 117. The through holes 113 are formed in positions corresponding to the plurality of bosses 111 and are formed to have an inside diameter smaller than the outside diameter of the boss 111. Incidentally, as shown in FIG. 27(*b*), a portion where a slit 120 described later is formed is formed thin up to the outer circumferential edge.

The drawing hole forming member 106 has the drawing hole 119 formed in the center portion 118 by penetrating the drawing hole forming member 106 and the slit 120 is formed between the drawing hole 119 and the outer circumferential edge of the drawing hole forming member 106. The slit 120 is formed in a position that continues to a slit-like gap formed in the extension 114 of the pinching hole 104 when the drawing hole forming member 106 is mounted on the mounting portion 107 of the base plate 101.

The configuration when the drawing hole forming member 106 is mounted on the mounting portion 107 formed as described above will be described based on FIG. 28. FIG. 28 is a sectional view of the base plate 101 and the drawing hole forming member 106 and FIG. 28(*a*) is a sectional view taken along an E-E' line of FIG. 25 and FIG. 28(*b*) is a sectional view taken along an F-F' line of FIG. 25. When, as shown in FIG. 28(*a*), the drawing hole forming member 106 is mounted on the mounting portion 107 of the base plate 101, the bosses 111 are inserted into the through holes 113 of the drawing hole forming member 106 and as shown in FIG. 28(*b*), the rib 112 of the drawing hole forming member 106 is locked into the locking hole 110. Also as shown in FIG. 28(*a*), the protruding portion 115 formed on the base plate 101 is configured to be positioned below the undersurface of the drawing hole forming member 106 mounted on the mounting portion 107.

Thus, a wet wipes package according to the fifth embodiment includes a mounting portion on which to mount a drawing hole forming member in a recess of a base plate and the mounting portion includes a sidewall portion provided upright from the upper surface of the base plate, a horizontal wall portion extending toward the inside diameter direction of an opening from the upper end portion of the sidewall portion, and a plurality of bosses extending downward from the undersurface of the horizontal wall portion and therefore, positioning of the drawing hole forming member with respect to the base plate is done reliably. According to a wet wipes package in the present embodiment, the precision of positioning of the drawing hole forming member when mounted on the mounting portion can enormously be improved by the insertion of the boss into each through hole and locking of a rib into each locking hole and an extension of the mounting portion and a slit formed in the drawing hole forming member can be arranged with precision so as to be continuous. With the drawing hole forming member being arranged as described above and further the position of a thin portion where the slit is formed is positioned above a protruding portion of the base plate and therefore, when a wet wipe is drawn from a drawing hole, the drawing hole forming member can be made to be elastically deformed more easily so that the user can be made not to perceive changes in resistance caused by changes in thickness of the wet wipes when the wet wipe is drawn out and also the wet wipe can be drawn out smoothly.

Also, in a wet wipes package according to the fifth embodiment, when a drawing hole forming member is mounted on a base plate, a boss formed in a mounting portion is inserted into a through hole of the drawing hole forming member and further a rib of the drawing hole forming member is locked into a locking hole and therefore, the drawing hole forming member can be prevented from falling more reliably when a still more downward force is applied. Accordingly, the possibility for the user to remount the drawing hole forming member that has fallen can be eliminated so that troublesomeness when using a wet wipes package can be reduced.

Also, according to a wet wipes package in the fifth embodiment, a drawing hole forming member can be mounted on a base plate by the simple method described above and a mounting hole forming member can be positioned by inserting a boss into a through hole and therefore, efficiency of mounting work during production can be improved so that production efficiency of a wet wipes package can further be improved.

In the fifth embodiment, an example having only a configuration in which a rib is locked into a locking hole is described, but a different configuration may also be adopted if a drawing hole forming member formed on a mounting portion can be prevented from falling. For example, the drawing hole forming member can reliably be prevented from falling by forming a claw-like protrusion from the undersurface side of a base plate to the inner circumferential side of the mounting portion. By forming a notch into which the protrusion is fitted in a position corresponding to the position where the protrusion also in the drawing hole forming member, fixing of the drawing hole forming member can be made more reliable and the drawing hole forming member can be prevented from falling more reliably.

Figure 29:
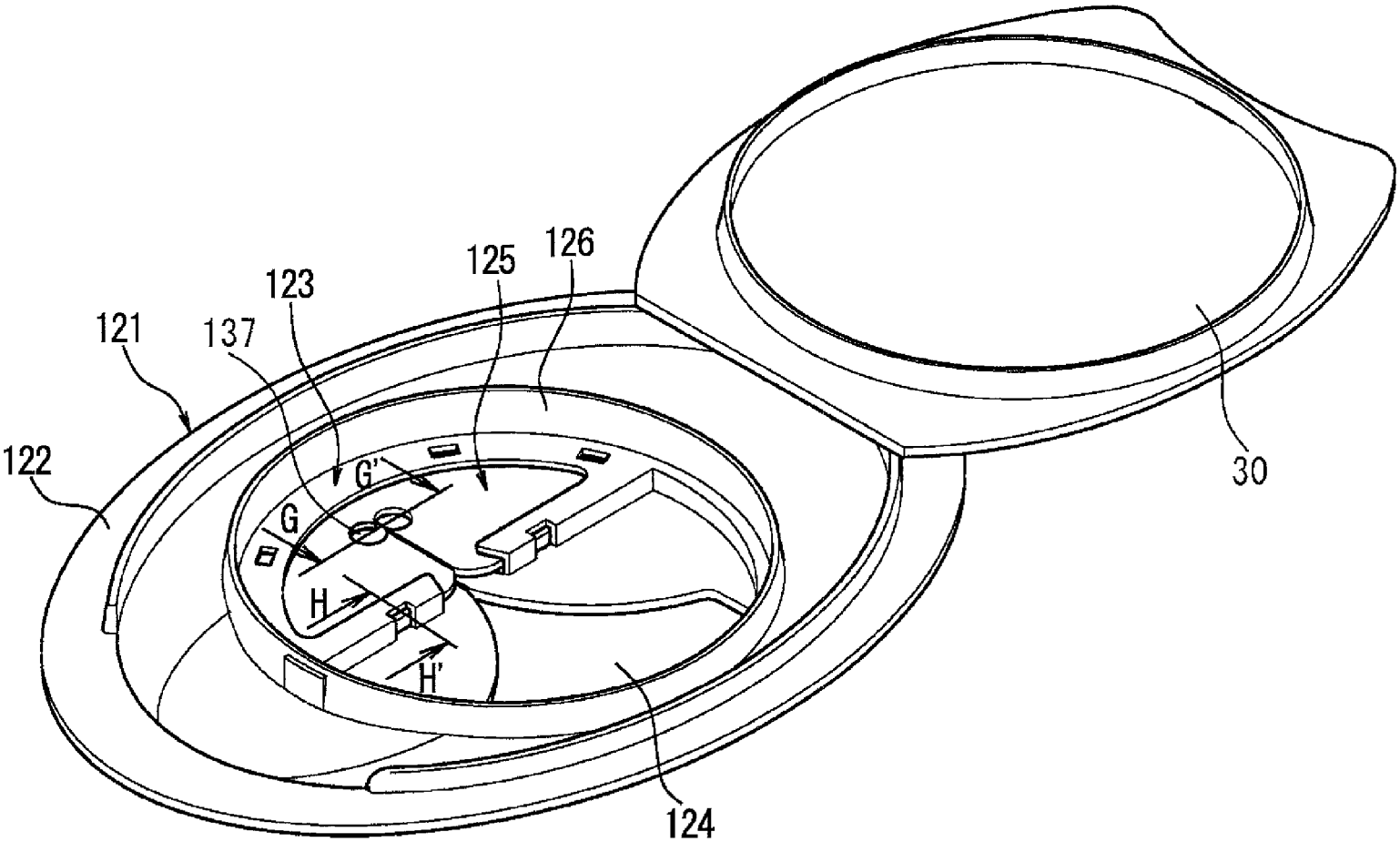
FIG. 29 is an external perspective view showing the external configuration of a base plate applied to a wet wipes package according to a sixth embodiment of the present invention.
Figure 30:
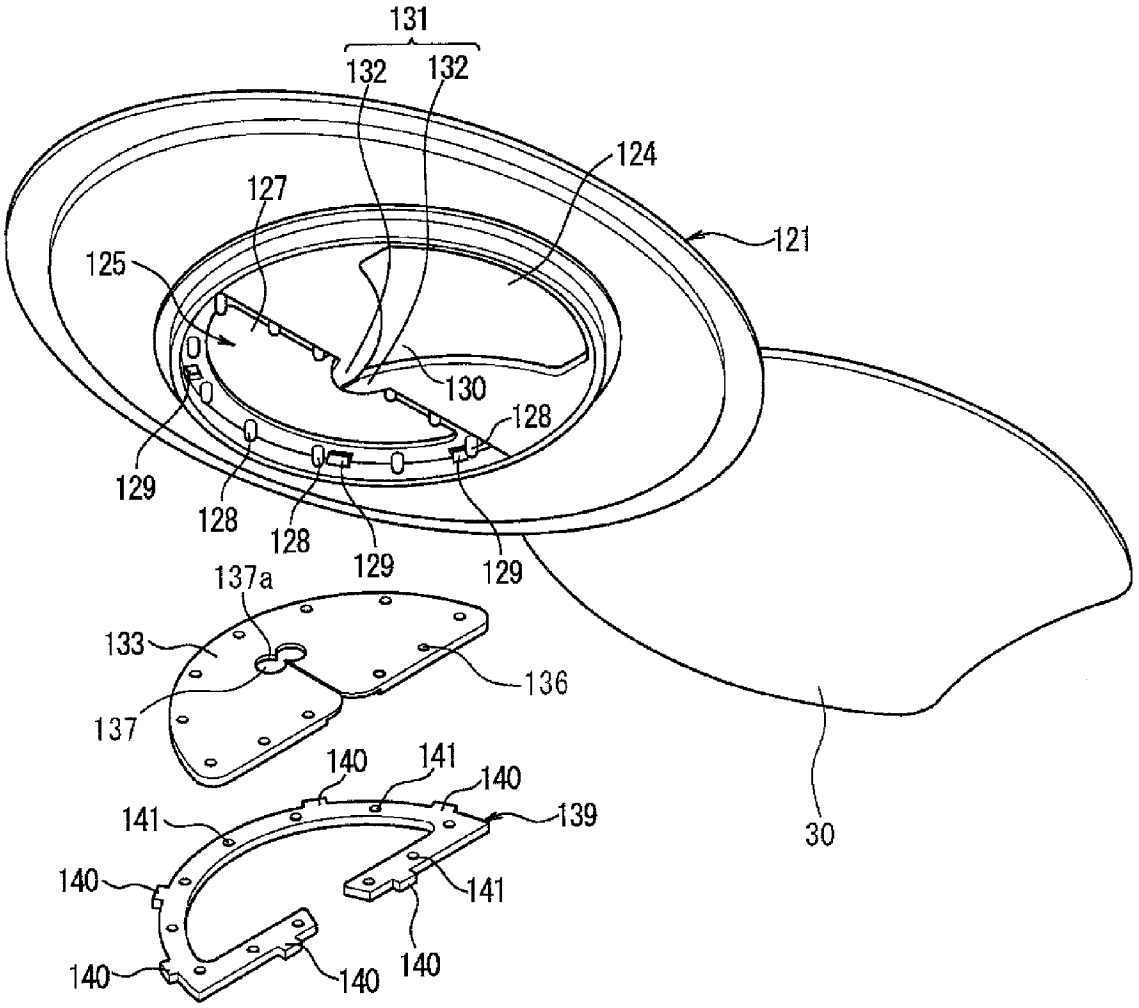
FIG. 30 is an exploded perspective view showing the configuration of the back side of the base plate.
Figure 31:
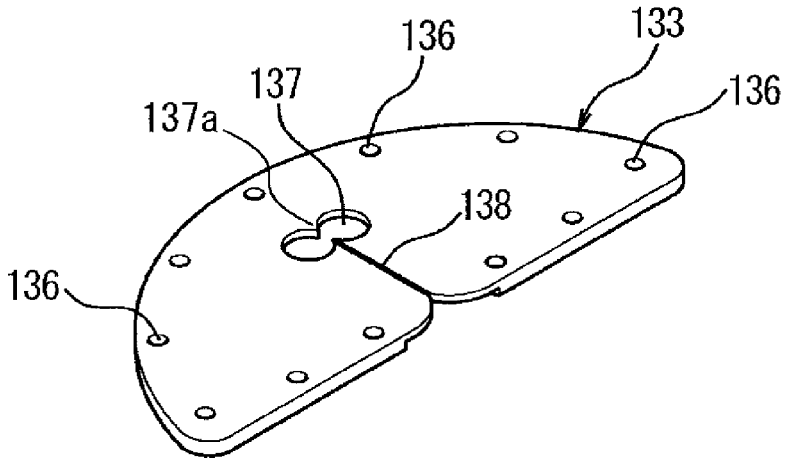
FIG. 31 is an external perspective view showing the configuration of a drawing hole forming member, wherein FIG. 31(*a*) is an external perspective view from above and FIG. 31(*b*) is an external perspective view from below.
Figure 31:
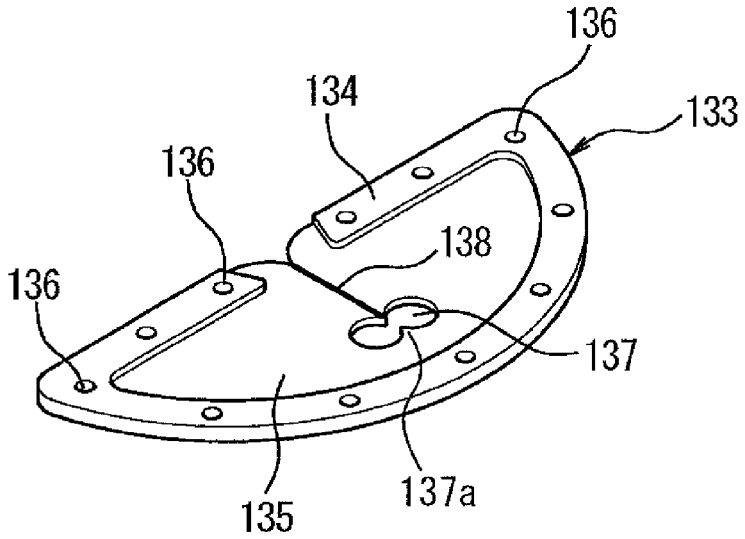
Figure 32:
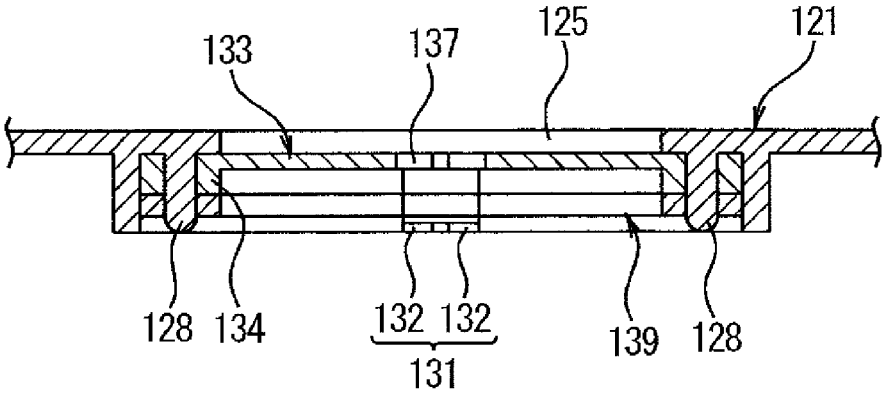
FIG. 32(*a*) is a sectional view taken along a G-G' line of FIG. 29 and FIG. 32(*b*) is a sectional view taken along an H-H' line of FIG. 29.
Figure 32:
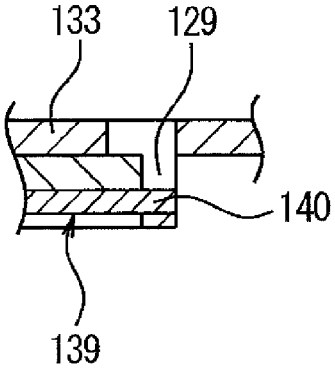
Figure 33:
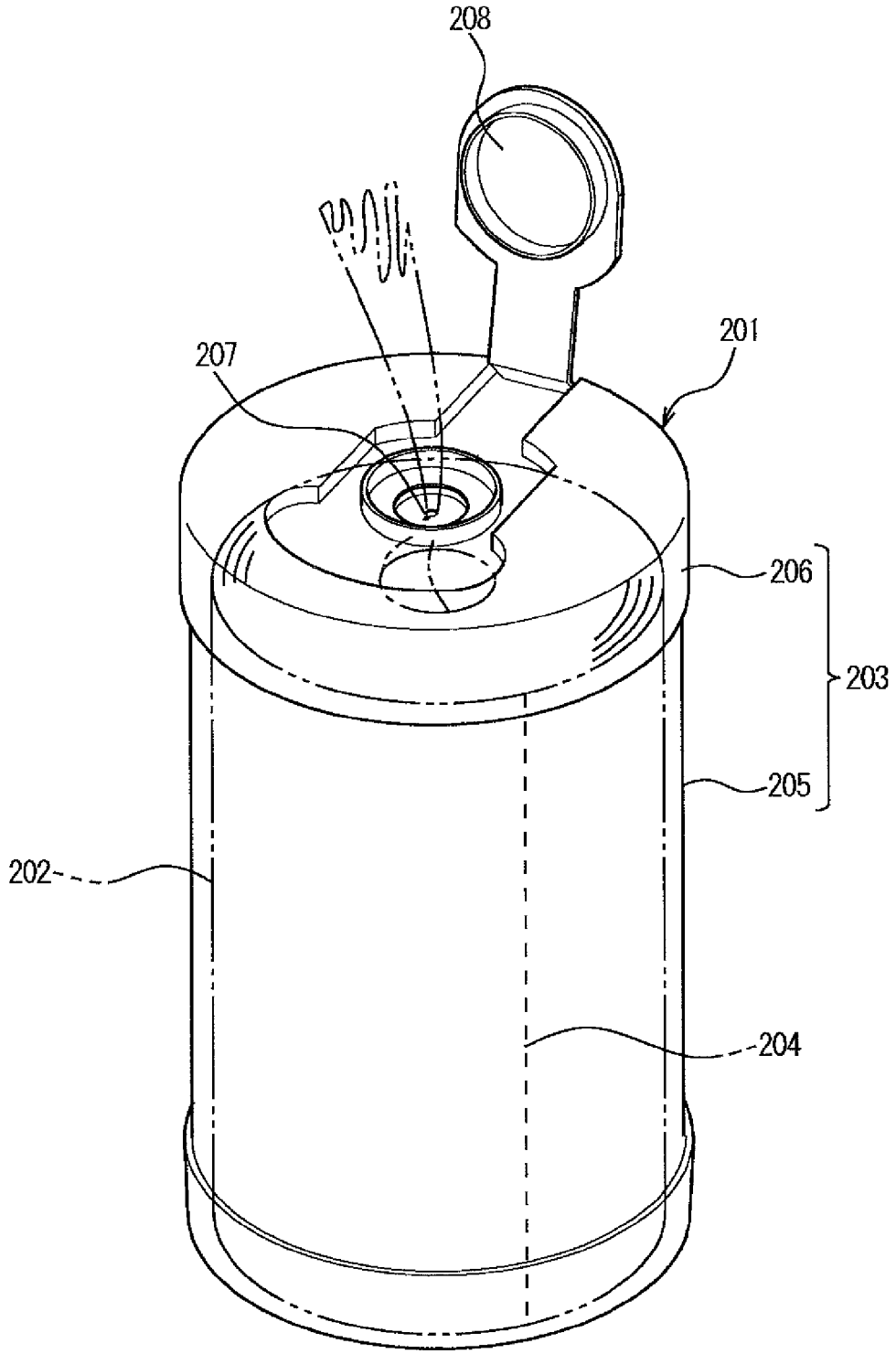
FIG. 33 is an external perspective view showing the external configuration of a conventional wet wipes package.

Next, a sixth embodiment of a wet wipes package of the present invention will be described based on FIGS. 29 to 32. FIG. 29 is an external perspective view showing the external configuration of a base plate applied to a wet wipes package according to the sixth embodiment of the present invention, FIG. 30 is an exploded perspective view showing the configuration of the back side of the base plate, FIG. 31 is an external perspective view showing the configuration of a drawing hole forming member, wherein FIG. 31(*a*) is an external perspective view from above and FIG. 31(*b*) is an external perspective view from below, and FIG. 32 is a sectional view of the base plate and FIG. 32(*a*) is a sectional view taken along a G-G' line of FIG. 29 and FIG. 32(*b*) is a sectional view taken along an H-H' line of FIG. 29. Also in the present embodiment, the configuration of the bag body and wet wipes folded body is the same as that described in the first embodiment and the configuration of the lid is the same as that described in the second embodiment and thus, the description and illustration thereof are omitted. Also in the present embodiment, a wet wipes folded body in which the dividing portion is formed by overlaying and stacking edges of wet wipes in Z folding, WZ folding, or W folding may be used or a wet wipes folded body in which a partially continuous portion like perforation is formed may be used.

As shown in FIGS. 29 and 30, a base plate 121 is formed in an elliptic shape and has a welding surface 122 to mount the base plate 121 on a bag body by an arbitrary method such as hot melt formed on the outer edge. A recess 123 depressed from the welding surface 122 is formed on the inner side of the welding surface 122. The recess 123 in the sixth embodiment is formed in such a way that a level difference is formed between a location where a pinching hole 124 is formed and a location where a mounting portion 125 on which a drawing hole forming member 133 described later can be mounted is provided and the location where the drawing hole forming member 133 is mounted is higher than the location where the mounting portion 125 is formed. In addition, the recess 123 has an upper wall portion 126 formed like surrounding the mounting portion 125 and the location where the mounting portion 125 is formed.

As shown in FIG. 30, a portion where the recess 123 is formed is formed like a convex protrusion on the undersurface side of the base plate 121 with the formation of the recess 123 on the upper surface side of the base plate 121. The pinching hole 124 is formed in the portion formed like a convex protrusion and the mounting portion 125 on which the drawing hole forming member 133 is mounted is formed in the location one level down (one level up when viewed from the front side) from the portion where the protrusion is formed. When viewed from the undersurface of the base plate 121, the mounting portion 125 is formed one level depressed from the location where the pinching hole 124 is formed and has an opening 127 formed in a crescent shape by penetrating up to the upper surface side of the base plate 121. The opening 127 is formed so as to be a region smaller than a region formed by being depressed when viewed the back side of the base plate 121 and eleven bosses 128 at regular intervals are formed on the undersurface of the perimeter of the opening 127 by protruding downward from the base plate 121. In addition, the mounting portion 125 is provided with locking holes 129 into which ribs formed on a mounting member described later are fitted at regular intervals.

A protruding portion 131 protruding toward a location one level depressed on the undersurface side is formed in a location where an extension 130 of the pinching hole 124 is formed on the undersurface side of the base plate 121. The protruding portion 131 is used to prevent, when a wet wipe is drawn from a drawing hole 137 of the drawing hole forming member 133 mounted on the base plate 121, the drawn wet wipe from moving from the drawing hole 137 to the mounting portion 125. The protruding portion 131 is formed of two protrusions 132 formed across the extension 130. The protruding portion 131 is formed in a crescent shape by combining these two protrusions 132, but the protruding portion 131 only needs to be able to prevent the wet wipe from moving from the drawing hole 137 to the mounting portion 125 and the shape thereof is not limited.

The drawing hole forming member 133 is used to form the drawing hole and is formed from an elastic member softer than the base plate 121. The drawing hole forming member 133 can be formed by arbitrarily using methods that have been publicly known and materials described in the fourth embodiment may arbitrarily selected and used as the material of the drawing hole forming member 133.

As shown in FIGS. 30 and 31, the drawing hole forming member 133 has an external shape formed in a substantially semicircle shape and is formed in such a way that an edge portion 134 on the back side is thicker than a center portion 135 formed on the center side of the edge portion 134. Eleven through holes 136 are formed in the edge portion 134 and these through holes 136 are formed in such positions where the bosses 128 formed on the mounting portion 125 can be inserted when the drawing hole forming member 133 is mounted. In addition, the drawing hole forming member 133 has the drawing hole 137 formed in the center portion 135 by penetrating the drawing hole forming member 133 and a slit 138 is formed between the drawing hole 137 and the outer circumferential edge of the drawing hole forming member 133. The slit 138 is formed in a position that continues to a tapering gap formed in the extension 130 of the mounting portion 125 when the drawing hole forming member 133 is mounted on the mounting portion 125 of the base plate 121.

As shown in FIGS. 30 and 31, the drawing hole 137 is formed in a shape formed by partially overlaying two circles and a protruding portion 137*a* is formed in a portion protruded and formed by the two circles being overlaid. The protruding portion 137*a* is used to increase frictional resistance provided to the wet wipe passing through the drawing hole 137 and is formed in a position opposite to the slit 138. In the sixth embodiment, the drawing hole 137 has a shape obtained by partially overlaying two circles, but the drawing hole 137 may be a hole formed from one circle or have any other shape. The drawing hole forming member 133 in the present embodiment may be formed in such a way that the center portion 135 and the edge portion 134 have the same thickness. In such a case, the thickness of the drawing hole forming member may arbitrarily be decided.

A fixing member 139 is provided to prevent the drawing hole forming member 133 mounted on the mounting portion 125 from falling and formed from a hard material such as a plastic material in the present embodiment. As shown in FIG. 30, the fixing member 139 is formed so as to have an outer circumferential shape substantially the same as that of the drawing hole forming member 133 and a plurality of protruding portions 140 is protrusion-molded from the outer circumferential surface thereof at predetermined intervals. The protruding portion 140 is formed in a shape that can be locked into the locking hole 129 and can maintain the locked state. The fixing member 139 is formed in a width substantially the same as the width of the thick portion 134 of the drawing hole forming member 133 and fixing holes 141 are formed at the same intervals as those of the through holes 136 of the drawing hole forming member 133. The fixing hole 141 is formed so as to have substantially the same inside diameter as the outside diameter of the boss 128.

The configuration when the drawing hole forming member 133 and the fixing member 139 are mounted on the mounting portion 125 of the base plate 121 formed as described above will be described based on FIG. 32. FIG. 32 is a sectional view of the base plate 121 on which the drawing hole forming member 133 and the fixing member 139 are mounted and FIG. 32(*a*) is a sectional view taken along a G-G' line of FIG. 29 and FIG. 32(*b*) is a sectional view taken along an H-H' line of FIG. 29. As shown in FIG. 32(*a*), the drawing hole forming member 133 is mounted from below the base plate 121. The drawing hole forming member 133 is formed in such a way that when the boss 128 is inserted into the through hole 136, the inside diameter of the through hole 136 is the same as the outside diameter of the boss 128 or smaller than the outside diameter of the boss 128 and therefore, after the boss 128 being inserted into the through hole 136, a state in which the drawing hole forming member 133 is mounted on the mounting portion 125 is maintained.

The fixing member 139 is mounted and fixed below the drawing hole forming member 133 in the mounting portion 125. The fixing member 139 is arranged so that the boss 128 is inserted into the fixing hole 141 and the protruding portion 140 is locked into the locking hole 129. In this case, the fixing member 139 is formed to have an external size that is substantially the same as the size in an inner circumferential direction of the mounting portion 125 or slightly smaller than the size of the mounting portion 125, but is formed to be larger than the mounting portion 125 in a location where the protruding portion 140 is formed. Thus, when mounted on the mounting portion 125, the fixing member 139 is pushed into the mounting portion 125 by using elastic deformation before being locked into the locking hole 129 formed slightly wider outwardly than the inner circumference of the mounting portion 125. Therefore, once the fixing member 139 is mounted on the mounting portion 125, with the protruding portion 140 being locked into the locking hole 129, the state in which the fixing member 139 is fixed to the fixing portion 125 is maintained and the drawing hole forming member 133 can be configured to be prevented from falling.

Also, as shown in FIG. 32(*a*), the protruding portion 131 formed on the base plate 121 is configured to be positioned below the undersurface of the drawing hole forming member 133 mounted on the mounting portion 125.

Thus, a wet wipes package according to the sixth embodiment is configured to form a mounting portion on the undersurface side of a base plate, form a boss on the mounting portion, insert the boss into a through hole of a drawing hole forming member, insert a fixing member into a fixing portion by using elastic deformation, and lock a protruding portion into a locking hole to mount the fixing member on the fixing portion and therefore, in addition to the effect in the fifth embodiment, commonality of the base plate and the fixing member can be achieved and drawing performance of wet wipes can easily be changed only by changing the thickness of the drawing hole forming member. Therefore, according to a wet wipes package in the present embodiment, drawing performance of wet wipes can easily be changed and the cost during production due to the change can be reduced drastically.

Also, in a wet wipes package in the sixth embodiment, a boss is inserted into a through hole of a drawing hole forming member and therefore, the drawing hole forming member can be prevented from being pulled out together with a wet wipe due to a tensile force provided when the wet wipe is drawn.

Herein, a drawing hole forming member according to the second embodiment is formed in a circular shape, a drawing hole forming member according to the first modification of the second embodiment is formed in a quadrangular shape, and a drawing hole forming member according to the second modification is formed in a circular shape, but the shape of a drawing hole forming member may be decided arbitrarily and, for example, an elliptic shape or other polygonal shapes or other shapes may also be adopted. Similarly, the shape of a drawing hole forming member according to the third embodiment may be any shape other than the circular shape and also the shape of a drawing hole forming member according to the fourth to sixth embodiments may be any shape other than the elliptic shape, for example, the circular shape or other shapes. That is, the shape of a drawing hole forming member is not limited to the above shapes if the drawing hole forming member can be elastically deformed easily when a wet wipe is drawn, the wet wipe can be drawn out smoothly, and the wet wipe can be divided at a dividing portion reliably.

In the second to sixth embodiments of the present specification, a drawing hole is formed in a drawing hole forming member formed from an elastic material and the whole drawing hole is formed by being surrounded by the elastic material, but a portion of the opening may be formed from an elastic material that can be elastically deformed and other portions may be formed from a hard material resistant to elastic deformation. When a drawing hole is formed from an elastic material and a hard material, the portion formed from an elastic material is preferably half the portion formed from a hard material or more.

Incidentally, the first to third embodiments of the present specification are a form of a wet wipes package according to the present invention and can appropriately be modified without deviating from the spirit of the present invention.

INDUSTRIAL APPLICABILITY

A wet wipes package in the present invention has a compact form, affords ease with which a wet wipe can be drawn out, and is useful for wiping one's hands or the buttocks of infants or aged people.

REFERENCE SIGNS LIST

1, 21, 51 wet wipes package
2 wet wipes folded body
2*a* wet wipe
3, 23 bag body
4 dividing portion
5 first folded portion
6 second folded portion
9 opening
10, 25, 54, 71, 101, 121 base plate
12, 27, 52, 74, 104, 124 pinching hole
12*a*, 27*a*, 52*a*, 82, 114, 130 extension
13, 36, 62, 87, 119, 137 drawing hole
15, 55, 85, 115, 131 protruding portion
16, 137*a* protrusion
17, 30 lid
28 mounting hole
32, 61, 83, 106, 133 drawing hole forming member
84, 112 rib
90, 113, 136 through hole
139 fixing member

The invention claimed is:

1. A wet wipes package that defines an airtight storage container, the wet wipes package comprising:

a wet wipes folded body of wet wipes which are continuously folded and stacked and in which dividing portions are formed in the wet wipes folded body at predetermined intervals, the airtight storage container being able to store the wet wipes folded body and having an opening formed to draw outward stored wet wipes;

a base plate mounted in the opening and having a pinching hole formed to pinch and draw outward the wet wipes;

a drawing hole linked to the pinching hole to draw out the wet wipes pinched outward from the pinching hole by dividing the wet wipes from the wet wipes folded body at each of the dividing portions, the drawing hole defining a protruding portion and a protrusion formed in a position opposite the protruding portion, and a widest portion of the pinching hole being wider than a widest portion of the drawing hole, the widest portion of the drawing hole being defined by a shape that is formed by partially overlaying two circles; and a freely openable/closable lid capable of hermetically sealing the pinching hole and the drawing hole.

2. The wet wipes package according to claim 1, wherein the drawing hole is configured to provide frictional resistance to the drawn wet wipes.

3. The wet wipes package according to claim 1, wherein the drawing hole is formed in the base plate disposed to an inside of a bag body where a portion of the opening is formed.

4. The wet wipes package according to claim 3, wherein the drawing hole is formed at a bottom of a recess of the base plate.

5. The wet wipes package according to claim 1, wherein the protruding portion formed in the drawing hole protrudes toward an inner side of the drawing hole.

6. The wet wipes package according to claim 1, wherein the pinching hole includes an extension extending toward the drawing hole and linked to the drawing hole and the extension is formed to taper down to a point toward the drawing hole.

7. The wet wipes package according to claim 1, wherein a bag body is formed like a bag in a pillow shape by sealing back and front ends of a film having airtightness.

8. The wet wipes package according to claim 1, wherein the drawing hole defines a first slit and a second slit that is opposite the first slit.

9. A base plate that is mounted in an opening member having an opening of a wet wipe package that is configured to store wet wipes, the base plate comprising:

a pinching hole configured to pinch and draw outward the wet wipes from the storage container; and a drawing hole linked to the pinching hole to draw out the wet wipes pinched outward from the pinching hole, the drawing hole defining a protruding portion and a protrusion formed in a position opposite the protruding portion, and a freely openable/closable lid capable of hermetically sealing the pinching hole and the drawing hole, wherein:

a widest portion of the pinching hole is wider than a widest portion of the drawing hole; and the widest portion of the drawing hole is defined by a shape that is formed by partially overlaying two circles.

* * * * *